US010670997B2

(12) United States Patent
Honya et al.

(10) Patent No.: US 10,670,997 B2
(45) Date of Patent: Jun. 2, 2020

(54) INTERMEDIATE TRANSFER BODY, METHOD FOR MANUFACTURING INTERMEDIATE TRANSFER BODY, AND IMAGE FORMING DEVICE

(71) Applicant: Konica Minolta, Inc., Tokyo (JP)

(72) Inventors: Akihiro Honya, Musashino (JP); Kazunori Kurimoto, Chofu (JP); Teruo Sasaki, Hino (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 16/557,265

(22) Filed: Aug. 30, 2019

(65) Prior Publication Data

US 2020/0081376 A1 Mar. 12, 2020

(30) Foreign Application Priority Data

Sep. 12, 2018 (JP) ..... 2018-170531

(51) Int. Cl.
*G03G 15/16* (2006.01)
*G03G 13/16* (2006.01)

(52) U.S. Cl.
CPC ..... *G03G 15/162* (2013.01); *G03G 13/16* (2013.01)

(58) Field of Classification Search
CPC ... G03G 13/16; G03G 15/0189; G03G 15/162
USPC ..... 399/302, 308; 430/125.32
See application file for complete search history.

(56) References Cited

U.S. PATENT DOCUMENTS

| | | | | |
|---|---|---|---|---|
| 8,929,785 | B1 * | 1/2015 | Roetker | G03G 15/1685 399/302 |
| 2014/0162068 | A1 * | 6/2014 | Yoshida | G03G 15/162 428/411.1 |
| 2016/0054668 | A1 * | 2/2016 | Yumita | G03G 5/14704 430/66 |
| 2017/0090353 | A1 * | 3/2017 | Sakamoto | G03G 15/162 |
| 2019/0086841 | A1 * | 3/2019 | Honya | C09J 133/08 |

FOREIGN PATENT DOCUMENTS

| | | |
|---|---|---|
| JP | 2012159838 A | 8/2012 |
| JP | 2013061383 A | 4/2013 |

* cited by examiner

*Primary Examiner* — Robert B Beatty
(74) *Attorney, Agent, or Firm* — Rankin, Hill & Clark LLP

(57) ABSTRACT

An intermediate transfer body used in an electrophotographic image forming device includes: at least a substrate layer and a surface layer, wherein the surface layer is formed by a cured product obtained by curing a coating liquid containing a curable compound, an inorganic filler, and a fluorine-based surfactant having a reactive group, and the surface layer has a pure water contact angle of 75° or more and 90° or less.

13 Claims, 4 Drawing Sheets

INTERMEDIATE TRANSFER BODY, METHOD FOR MANUFACTURING INTERMEDIATE TRANSFER BODY, AND IMAGE FORMING DEVICE

The entire disclosure of Japanese patent Application No. 2018-170531, filed on Sep. 12, 2018, is incorporated herein by reference in its entirety.

BACKGROUND

Technological Field

The present invention relates to an intermediate transfer body, a method for manufacturing the intermediate transfer body, and an image forming device including the intermediate transfer body.

Description of the Related Art

In an electrophotographic image forming device, usually, a toner image formed by a photoreceptor is primarily transferred onto an intermediate transfer body and then secondarily transferred onto a recording medium such as plain paper. The primary transfer and the secondary transfer of the toner image are usually performed by attachment and detachment of a toner by controlling charges on a surface of the intermediate transfer body. As the intermediate transfer body, an endless belt having a resin substrate layer and a resin surface layer disposed on the substrate layer and enhancing durability of the intermediate transfer body is known. In general, the surface layer contains a large amount of filler in order to control surface charges and to improve durability and wear resistance.

As a method for forming a surface layer on a substrate layer, a spray applying method or a spiral applying method with a surface layer forming coating liquid is generally used. However, as described above, since the surface layer contains a large amount of filler, the surface layer forming coating liquid also contains a large amount of filler. When a coating liquid containing a large amount of filler is used, the above method easily causes an application streak due to a joint of droplets or beads. Therefore, a method for adding a leveling agent such as silicone oil to a coating liquid to smooth a coated surface is known. However, with a leveling agent such as silicone oil, the coated surface cannot be sufficiently smoothed. Therefore, use of a fluorine-based compound has been studied.

For example, JP 2012-159838 A discloses a film forming composition for manufacturing an intermediate transfer belt containing a nonionic surfactant and a fluorinated surfactant. JP 2012-159838 A describes that it is possible to obtain a film having low surface energy and improved uniformity because the film forming composition can reduce surface tension of the film forming coating liquid by inclusion of the fluorinated surfactant in the coating liquid.

JP 2013-61383 A discloses a tubular member having a surface layer containing a multi-branched polymer compound containing a fluorine atom and a polyimide. JP 2013-61383 A describes that the multi-branched polymer compound containing a fluorine atom contained in the tubular member contributes to improvement of releasability of the surface layer because the multi-branched polymer compound is present as a spherical polymer in polyimide and is therefore hardly aggregated even when being dispersed.

JP 2012-159838 A and JP 2013-61383 A use a fluorine-based compound for surface modification of a surface layer, but neither JP 2012-159838 A nor JP 2013-61383 A can sufficiently suppress occurrence of an image defect derived from an application streak generated at the time of forming the surface layer. In particular, when a surface layer is formed by spiral applying, a solvent contained in a previously applied bead coating liquid is evaporated. Therefore, when an adjacent bead is applied, two coating liquids having different solid concentrations are in contact with each other. At this time, the previously applied bead coating liquid is rapidly reduced in concentration by the bead coating liquid applied in adjacent thereto, and easily causes a solvent shock that a solid content such as an inorganic filler is aggregated. When a solvent shock occurs, leveling of a coating liquid is inhibited, and an application streak is easily formed. When an image is formed using an intermediate transfer body on which an application streak has been formed in this manner, a streaky image defect easily occurs. In addition, each of the surface layers in JP 2012-159838 A and JP 2013-61383 A has a large pure water contact angle, is easily peeled off when a reinforcing tape is stuck to an end of an intermediate transfer body, and therefore cannot withstand long-term use.

SUMMARY

The present invention has been achieved in view of the above points, and an object of the present invention is to provide an intermediate transfer body that can suppress occurrence of a streaky image defect and makes it difficult for a reinforcing tape stuck to an end to be peeled off. Another object of the present invention is to provide a method for manufacturing the intermediate transfer body and an image forming device including the intermediate transfer body.

To achieve at least one of the abovementioned objects, according to an aspect of the present invention there is provided an intermediate transfer body used in an electrophotographic image forming device, and the intermediate transfer body reflecting one aspect of the present invention comprises: at least a substrate layer and a surface layer, wherein the surface layer is formed by a cured product obtained by curing a coating liquid containing a curable compound, an inorganic filler, and a fluorine-based surfactant having a reactive group, and the surface layer has a pure water contact angle of 75° or more and 90° or less.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
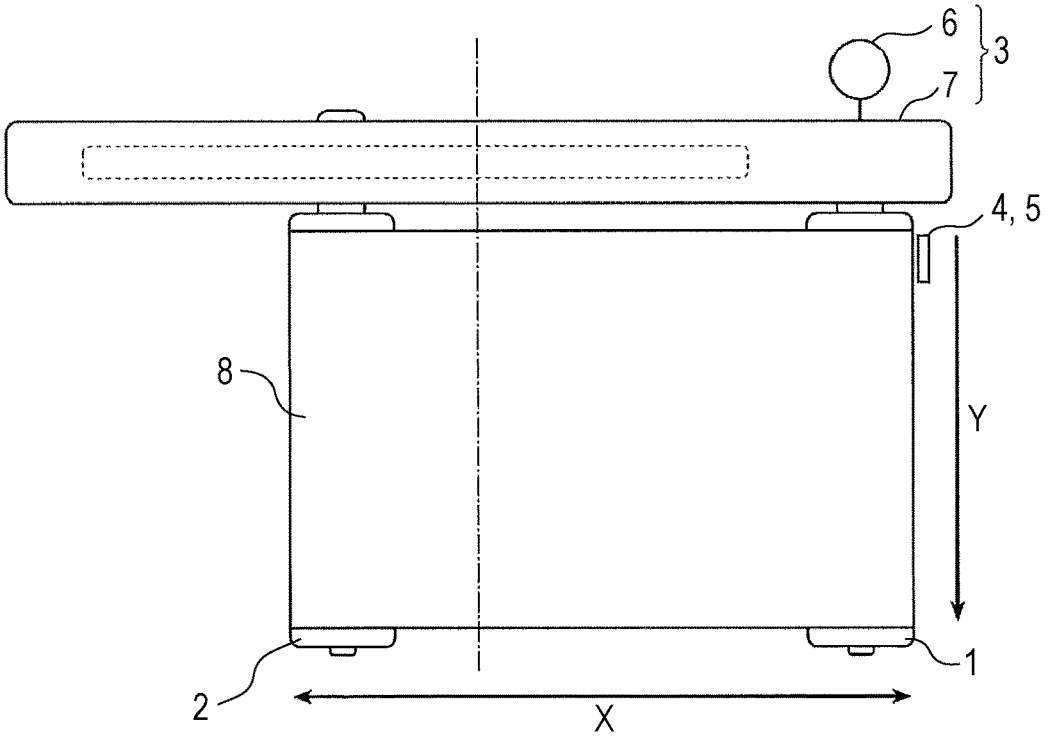
FIG. 1 is a schematic view illustrating a part of an intermediate transfer belt manufacturing device according to an embodiment.

Hereinafter, an intermediate transfer body, a method for manufacturing the intermediate transfer body, and an image forming device including the intermediate transfer body according to an embodiment of the present invention will be described in order with reference to the drawings. However, the scope of the invention is not limited to the disclosed embodiments.

[Intermediate Transfer Body]

The intermediate transfer body is an endless belt having a substrate layer and a surface layer. The intermediate transfer body has at least two potentials because of being disposed in contact with or in the vicinity of a plurality of charging members, receives a toner image from the outside by voltage control of the plurality of charging members, and can deliver the toner image received from the outside to a subsequent recording material. Note that an elastic layer may be included between the substrate layer and the surface layer.

The intermediate transfer body has an endless belt shape. Here, the "endless belt shape" conceptually (geometrically) means, for example, a loop shape formed by joining both ends of one elongated sheet-shaped material. The actual shape of the intermediate transfer body is preferably a seamless belt shape or a cylindrical shape.

(Substrate Layer)

The substrate layer is an endless belt having desired conductivity and flexibility. The substrate layer is formed by, for example, a flexible resin. Examples of the resin forming the substrate layer include a resin having a structural unit containing a benzene ring, such as aromatic polyimide (PI), aromatic polyamide imide (PAI), polyphenylene sulfide (PPS), aromatic polyether ether ketone (PEEK), aromatic polycarbonate (PC), or aromatic polyether ketone (PEK), polyvinylidene fluoride, and a mixture and a copolymer thereof. Among these resins, as the substrate layer, a resin having a structural unit containing a benzene ring is preferably used, and a resin selected from the group consisting of poly imide (PI), polyamide imide (PAI), and polyphenylene sulfide (PPS) is more preferably used from a viewpoint of further enhancing flame retardancy, strength, and durability. The substrate layer is still more preferably formed using polyphenylene sulfide (PPS) from a viewpoint of reducing manufacturing cost.

Note that the substrate layer may be formed by a crystalline resin. Here, the crystalline resin is a resin containing a "crystal" in which molecular chains are regularly arranged and having a glass transition temperature and a melting point. The crystalline resin can be confirmed in the substrate layer, for example, with a differential scanning calorimeter (DSC) and an X-ray diffraction device. Examples of the crystalline resin include polyphenylene sulfide (PPS) and polyether ether ketone (PEEK).

Phenylene in the polyphenylene sulfide (PPS) preferably contains p-phenylene, and more preferably contains unsubstituted p-phenylene. The content of substituted or unsubstituted p-phenylene in the polyphenylene sulfide is preferably 50% or more of the entire phenylene.

The substrate layer may contain a component other than the above resin. For example, the substrate layer may contain an inorganic filler. The inorganic filler is, for example, a component that contributes to improvement in at least one of the hardness, heat transferability, and conductivity of the substrate layer. Examples of the inorganic filler include carbon black, Ketjen black, nanocarbon, and graphite. The inorganic filler may be used singly or in combination of two or more types thereof.

The substrate layer can be manufactured by a conventionally known general method. For example, the substrate layer can be manufactured into an annular shape (endless belt shape) by melting a heat resistant resin as a material by an extruder, shaping the melted product into a tubular shape by an inflation method using an annular die, and then cutting the shaped product into round slices.

The substrate layer may also be surface-treated. The method for surface-treating the substrate layer is not particularly limited. However, the substrate layer may be surface-treated by UV irradiation, a corona treatment, an ozone treatment, a blast treatment, a texture treatment, and a coupling agent application.

The substrate layer has a thickness of preferably 30 to 140 μm more preferably 50 to 130 μm. The thickness of the substrate layer can be determined, for example, as a measured value obtained from a cross section when the intermediate transfer body is cut in a lamination direction thereof, or an average value thereof.

(Surface Layer)

The surface layer is disposed on an outer peripheral surface of the substrate layer. The surface layer is formed by a cured product of a mixture (coating liquid) containing a curable compound, an inorganic filler for controlling a surface charge or adjusting surface hardness, a surfactant, and the like. Here, the "curable compound" refers to a resin material that is polymerized and crosslinked by irradiation with an actinic ray (mainly an ultraviolet ray).

Examples of the cured product forming the surface layer include an acrylic resin, a urethane acrylic resin, and an epoxy resin.

The thickness of the surface layer is not particularly limited, but is preferably 0.5 to 10 μm, and more preferably 1.0 to 8.0 μm. In a case where the thickness of the surface layer is 0.5 μm or more, curing inhibition by surface oxygen can be suppressed when curing by an actinic ray is performed. Therefore, only good film quality of the surface layer can be obtained in the entire depth direction but also insufficient strength expected from an insufficient film thickness can be suppressed. In a case where the thickness is 10 μm or less, it is possible to suppress absorption or scattering of an actinic ray used for curing by an initiator or an inorganic filler near a surface of the surface layer. Therefore, a sufficient amount of actinic ray can reach a deep part of the surface layer near an interface between the surface layer and the substrate layer. As a result, a photocuring reaction sufficiently proceeds, and therefore durability of the surface layer can be improved.

The surface layer in an embodiment of the present invention has a pure water contact angle of 75° or more and 90° or less, preferably 75° or more and 85° or less. With the pure water contact angle within the above range, adhesion to a reinforcing tape for reinforcing an end of the intermediate transfer body can be improved.

The surface layer is formed by applying a coating liquid containing a curable compound, an additive such as a polymerization initiator, an inorganic filler, a surfactant, a solvent, or the like onto the substrate layer and curing the coating liquid.

Examples of the inorganic filler contained in the coating liquid include silicon dioxide (silica), carbon black, graphite, aluminum, copper, zinc, aluminum oxide (alumina), tin oxide, zinc oxide, antimony oxide, indium oxide, titanium oxide, potassium titanate, titanium nitride, silicon nitride, aluminum-doped zinc oxide, antimony-doped tin oxide, phosphorus-doped tin oxide, tin-doped indium oxide, antimony oxide-tin oxide composite oxide (ATO), and indium oxide-tin oxide composite oxide (ITO).

Among the inorganic fillers, silicon dioxide (silica), aluminum oxide (alumina), titanium oxide, and tin oxide are preferable, and conductive tin oxide is more preferable. The inorganic filler used in the present invention is preferably tin oxide from a viewpoint of the hardness of the surface layer and conductivity.

A surface of the inorganic filler (metal oxide fine particle) is preferably surface-treated so as to be modified with a reactive group having a structure represented by formula (1). The inorganic filler surface-treated so as to be modified with a reactive group having a structure represented by the formula (1) has good compatibility with a curable compound (particularly, a (meth)acrylate-based monomer), and therefore easily suppresses generation of an application streak due to aggregation of the inorganic filler.

[Chemical formula 1]

$$CH_2{=}C(R_1)COO(CH_2)_nSiI— \quad (1)$$

(In formula (1), $R_1$ represents a hydrogen atom or a methyl group. n represents an integer of 3 to 6.)

The surface treatment of the inorganic filler (metal oxide fine particle) may be a treatment of physically carrying a coating component such as a resin having the above reactive group on a surface of a metal oxide or a treatment of chemically bonding a compound having the above reactive group to a surface of a metal oxide. Here, examples of a treatment method for chemically bonding a compound having the above reactive group to a surface of a metal oxide include a coupling treatment with a silane coupling agent. The silane coupling agent preferably has a radically polymerizable functional group such as a (meth)acyloyloxy group from a viewpoint of improving dispersibility of the metal oxide in the surface layer and mechanical strength of the surface layer. Examples of the silane coupling agent having the above reactive group include the following compounds S-1 to S-31. Note that conditions of the surface treatment of the inorganic filler will be described in detail separately.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)Cl_2$
S-9: $CH_2{=}CHCOO(CH_2)_2SiCl_3$
S-10: $CH_2{=}CHCOO(CH_2)_3Si(CH_3)Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_2Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)Cl_2$
S-17: $CH_2{=}C(CH_3)COO(CH_2)_2SiCl_3$
S-18: $CH_2{=}C(CH_3)COO(CH_2)_3Si(CH_3)Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2(OCH_3)$

The coating liquid preferably contains a surface-treated inorganic filler in an amount of 10 parts by volume or more and 30 parts by volume or less with respect to 100 parts by volume of the sum of the curable compound and the inorganic filler. By setting the amount of the inorganic filler to 10 parts by volume or more and 30 parts by volume or less, the hardness of the surface layer can be easily adjusted.

The coating liquid contains a curable compound that is polymerized and crosslinked by irradiation with an actinic ray (mainly an ultraviolet ray). Examples of the curable compound that is polymerized by irradiation with an actinic ray include a photocurable monomer such as a radically polymerizable monomer.

Examples of the radically polymerizable monomer include various monomers such as a styrene-based monomer, an acrylic monomer, a methacrylic monomer, a vinyl toluene-based monomer, a vinyl acetate-based monomer, and an N-vinylpyrrolidone-based monomer.

The radically polymerizable monomer preferably has a (meth)acryloyloxy group from a viewpoint of saving irradiation energy of an actinic ray or shortening manufacturing work time. Furthermore, the radically polymerizable monomer is preferably a (meth)acrylate-based monomer, and more preferably a polyfunctional (meth)acrylate-based monomer in order to form a surface layer having adhesion to the substrate layer, and laving sufficient mechanical strength to protect the substrate layer and flexibility capable of following deformation of the substrate layer. Note that the "(meth)acryloyl group" is a generic term for an acryloyl group and a methacryloyl group, and means one or both of these groups. The (meth)acrylate means one or both of an acrylate and a methacrylate.

The polyfunctional acrylate-based monomer preferably has three or more (meth)acryloyl groups, and more preferably has four or more (meth)acryloyl groups. The polyfunctional monomer preferably has an acryloyl group equivalent of 150 g/eq or more and 250 g/eq or less. This is because a surface layer formed by a cured product of a coating liquid containing a monomer having an acryloyl group equivalent within the above range and having a molecular weight so as to have three or more (meth)acryloyl groups easily follows deformation of the substrate layer.

Examples of the polyfunctional (meth)acrylate-based monomer include pentaerythritol triacrylate, pentaerythritol tetraacrylate, dipentaerythritol hexaacrylate (DPHA), trimethylolpropane triacrylate, propoxylated (2) neopentyl glycol diacrylate, ethylene oxide modified dipentaerythritol hexaacrylate (DPEA), propylene oxide modified dipentaerythritol hexaacrylate (DPPA), caprolactone modified pentaerythitol hexaacrylate (DPCA), ethylene oxide modified pentaerythritol tetraacrylate, ethylene oxide modified glycerin triacrylate, propylene oxide modified glycerin triacrylate, dimethylol-tricyclodecane diacrylate (DCP-A), and ethylene oxide modified bisphenol A diacrylate. In particular, this is because trifunctional or higher functional pentaerythritol triacrylate or the like is effective for largely shortening curing time because of quickly reacting and being cured by irradiation with an actinic ray, and can enhance mechanical strength such as solvent resistance or scratch resistance.

The polyfunctional monomer may be an alicyclic monomer, an ethylene oxide modified acrylate, a propylene oxide modified acrylate, or the like. This is because an alicyclic monomer, an ethylene oxide modified monomer, a propylene oxide modified monomer, or the like has a small curing shrinkage property.

The curable compound preferably contains a monofunctional monomer having a long chain alkyl group represented by formula (2). The monofunctional monomer having a long chain alkyl group represented by formula (2) forms a micelle structure in which an inorganic filler (in particular, a surface-treated inorganic filler) is coated with the monofunctional monomer with the long chain alkyl group oriented outward. Therefore, the monofunctional monomer having a long chain alkyl group represented by formula (2) can suppress generation of an application streak due to aggregation of the inorganic filler.

[Chemical formula 2]

$$CH_2{=}C(R_2)COO(CH_2)_mCH_3 \quad (2)$$

(In formula (2), $R_2$ represents a hydrogen atom or a methyl group. m represents an integer of 14 to 20.)

Examples of the long chain alkyl group having 14 to 20 carbon atoms include a palmityl group, a cetyl group, a stearyl group, an isomyristyl group, an isocetyl group, a tetradecanoyl group, a pentadecanoyl group, a hexadecanoyl group, a heptadecanoyl group, a stearoyl group, an isotetradecanoyl group, an isopentadecanoyl group, an isohexadecanoyl group, an isopalmityl group, and an isoheptadecanoyl group.

The coating liquid preferably contains the monofunctional monomer having a long chain alkyl group in an amount of 5 parts by volume or more and 20 parts by volume or less with respect to 100 parts by volume of the sum of the curable compound and the inorganic filler. By inclusion of the monofunctional monomer having a long chain alkyl group within a range of 5 parts by volume or more and 20 parts by volume or less, the inorganic filler is well dispersed, sedimentation of the inorganic filler in the coating liquid hardly occurs, and aggregation can be suppressed.

When a polymerization cured product of the radically polymerizable monomer is prepared, a polymerization initiator is used. Here, examples of the polymerization initiator include: an acetophenone such as diethoxyacetophenone, 2-hydroxy-2-methyl-1-phenylpropan-1-one, 1-[4-(2-hydroxyethoxy)-phenyl]-2-hydroxy-2-methyl-1-propan-1-one, benzyl dimethyl ketal, 1-hydroxycyclohexyl phenyl ketone, 2-methyl-1-[4-(methylthio) phenyl]-2-morpholinopropan-1-one, 2-benzyl-2-dimethylamino-1-(4-morpholinophenyl) butanone, 2-hydroxy-1-{4-[4-(2-hydroxy-2-methylpropionyl)benzyl]phenyl}-2-methylpropan-1-one, or 2-hydroxy-2-methyl-1-[4-(1-methylvinyl)phenyl]propanone oligomer, a benzoin such as benzoin, benzoin methyl ether, benzoin ethyl ether, benzoin isopropyl ether, or benzoin isobutyl ether, a benzophenone such as benzophenone, methyl O-benzoyl benzoate, 4-phenylbenzophenone, 4-benzoyl-4'-methyl-diphenyl sulfide, 3,3',4,4'-tetra(t-butylperoxycarbonyl) benzophenone, 2,4,6-trimethylbenzophenone, 4-benzoyl-N,N-dimethyl-N-[2-(1-oxo-2-propenyloxy)ethyl]benzenemethanaminium bromide, or (4-benzoylbenzyl)trimethylammonium chloride; a thioxanthone such as 2-isopropylthioxanthone, 4-isopropylthioxanthone, 2,4-diethylthioxanthone, 2,4-dichlorothioxanthone, 1-chloro-4-propoxythioxanthone, or 2-(3-dimethylamino-2-hydroxy)-3,4-dimethyl-9H-thioxanthon-9-one meso chloride; an oxime ester such as 1,2-octanedione, 1-[4-(phenylthio)-,2-(O-benzoyl oxime)] or ethanone, 1-[9-ethyl-6-(2-methylbenzoyl)-9H-carbazol-3-yl]-,1-(O-acetyloxime); and an acyl phosphine oxide such as (2,4,6-trimethyl benzoyl)-diphenyl phosphine oxide or bis(2,4,6-trimethyl benzoyl)-phenyl phosphine oxide.

Among the above polymerization initiators, an oxime ester compound is preferable. Examples of these initiators include Irgacure OXE01, Irgacure OXE02 (manufactured by BASF SE, "Irgacure" is a registered trademark of BASF SE), TR-PBG-304 (manufactured by Changzhou Tronly New Electronic Materials Co., Ltd.), and TR-PBG-305 (manufactured by Changzhou Tronly New Electronic Materials Co., Ltd.). Another radical polymerization initiator such as acyl phosphine oxide (for example, Irgacure TPO (manufactured by BASF SE)) may be used, or an initiator corresponding to photo anionic polymerization or photo cationic polymerization may be used. Since the intermediate transfer body according to the embodiment of the present invention is black or dark close to black, an oxime ester-based initiator (Irgacures OXE01 and OXE02 and the like) having excellent quantum yield and reactivity is more preferable from a viewpoint of securing quality of a curing reaction. These polymerization initiators may be used singly or in combination of two or more types thereof.

The blending amount of a polymerization initiator is preferably 0.3 to 25% by mass, more preferably 1 to 20% by mass, and still more preferably 2 to 15% by mass with respect to the total amount of radically polymerizable monomers. Here, in a case where the blending amount of a polymerization initiator is 0.3% by mass or more, a sufficient amount of photoradicals are generated. Therefore, a polymerization reaction proceeds smoothly, and a surface layer having desired characteristics can be obtained. In a case where the blending amount is 25% by mass or less, absorbance derived from the polymerization initiator and the filler does not become too large, and therefore an actinic ray can reach the vicinity of an interface of the substrate layer. This can generate a sufficient amount of photoradicals also from the initiator in the deep part of the surface layer near the interface of the substrate layer. This can also suppress a decrease in curing reaction ratio near the interface of the substrate layer, peeling due to a decrease in adhesion strength of an interface between the surface layer and the substrate layer, and bleeding out of unreacted monomers remaining on the interface between the surface layer and the substrate layer.

In radical polymerization, various organic amine compounds can be used in combination. In radical polymerization, oxygen inhibition is a problem. However, by mixing these materials, oxygen inhibition can be reduced, and therefore reaction conditions can be relaxed.

In addition to the above radical polymerization, anionic polymerization and cationic polymerization can also be used. In the case of anionic polymerization or cationic polymerization, an anion generator and a cation generator corresponding thereto can be used. Examples of a photo anion generator that can be used in anionic polymerization include a carbamate, an acyl oxime, and an ammonium salt. Examples of a photo cation generator that can be used in cationic polymerization include an organic sulfonium-based compound, an iodonium-based compound, and a phosphonium-based compound.

The coating liquid contains a surfactant for adjusting surface tension to suppress occurrence of a streaky image defect. Examples of the surfactant include an ionic surfactant (an anionic surfactant, a cationic surfactant, and an amphoteric surfactant), a nonionic surfactant, a fluorine-based surfactant (ionic or nonionic), and a silicone-based surfactant.

Among the above surfactants, a non-ionic surfactant is preferable from a viewpoint of being chemically stable and exhibiting excellent dispersing action, and a fluorine-based surfactant is preferable from a viewpoint of further suppressing occurrence of a streaky image defect. The surface layer in an embodiment of the present invention preferably contains a nonionic fluorine-based surfactant having both of the above properties.

The surfactant contained in the coating liquid is a fluorine-based surfactant having a reactive group. The fluorine-based surfactant having a reactive group can improve a dispersed state of an inorganic filler contained in a surface layer forming coating liquid. This can suppress aggregation of the inorganic filler, can thereby suppress a leveling defect due to a solvent shock, and therefore suppresses generation of an application streak.

The fluorine-based surfactant having a reactive group has better compatibility with a curable compound than a fluorine-based surfactant having no reactive group. This can suppress extreme surface orientation of the fluorine-based surfactant, and therefore can suppress bleeding out to suppress a decrease in adhesion of an end tape. Therefore, since adhesion to a reinforcing tape stuck to an end of the intermediate transfer body is also good, it is possible to provide an intermediate transfer body that can withstand long-term use. Note that a fluorine-based surfactant having no reactive group is extremely easily surface-oriented, therefore easily causes bleeding out, and makes it difficult to adjust surface energy of the surface layer by adjusting an addition amount.

The reactive group is not limited as long as being able to improve a dispersed state of an inorganic filler and to suppress generation of an application streak, but is preferably the same functional group as a reactive group included in a curable monomer. For example, when the curable monomer is a curable compound having a (meth)acryloyl group, the fluorine-based surfactant having a reactive group preferably has a (meth)acryloyl group.

Here, the coating liquid contains a fluorine-based surfactant having a reactive group preferably in an amount of 0.01 parts by volume or more and 0.20 parts by volume or less, more preferably in an amount of 0.01 parts by volume or more and 0.10 parts by volume or less with respect to 100 parts by volume of the sum of a curable compound and an inorganic filler. By inclusion of the reactive group within a range of 0.01 parts by volume or more and 0.20 parts by volume or less, the pure water contact angle of the surface layer is adjusted to the above range to be able to further improve adhesion between the intermediate transfer body and the reinforcing tape.

A solvent can be appropriately selected from compounds having compatibility with a material contained in the coating liquid containing the curable compound and not inhibiting dispersibility of a filler. Examples of the solvent include methanol, ethanol, n-propyl alcohol, isopropyl alcohol, n-butanol, t-butanol, s-butanol, benzyl alcohol, toluene, xylene, methylene chloride, methyl ethyl ketone, methyl isobutyl ketone, cyclohexane, ethyl acetate, butyl acetate, methyl cellosolve, ethyl cellosolve, tetrahydrofuran, 1-dioxane, 1,3-dioxolane, pyridine, and diethylamine. The solvents may be used singly or in combination of two or more types thereof. The content of the solvent in the coating liquid can be determined, for example, based on applicability of the coating liquid, and is, for example, an amount that makes the concentration of a solid content in the coating liquid 5 to 90% by mass.

The mixture (coating liquid) is applied to a surface of the substrate layer by a spiral applying method and then cured.

A method for curing the mixture (coating liquid) is preferably irradiation with an actinic ray (mainly an ultraviolet ray). The actinic ray is an electromagnetic wave that radically polymerizes a photocurable monomer, that is, a curable compound, and examples thereof include an ultraviolet ray, an electron ray, and a γ ray. Among these rays, the actinic ray is preferably an ultraviolet ray or visible light with a wavelength of 450 nm or less, and is more preferably an ultraviolet ray from a viewpoint that handling is easy and high energy can be easily obtained.

The type of a light source of the actinic ray includes a low pressure mercury lamp, a medium pressure mercury lamp, an extra high pressure mercury lamp, a carbon arc lamp, a metal halide lamp, a xenon lamp, a flash (pulse) xenon, and a UV-LED irradiation device including UV-LED. Among these light sources, the UV-LED irradiation device including UV-LED is preferable. Curing conditions of the surface layer will be described separately in Examples.

(Elastic Layer)

The intermediate transfer body according to the embodiment of the present invention may have an elastic layer between the substrate layer and the surface layer depending on a purpose.

A material of the elastic layer is preferably a heat resistant rubber. Examples of the heat resistant rubber include a natural rubber, a styrene-butadiene rubber (SBR), a butyl rubber, a chloroprene rubber, a nitrile rubber, an acrylic rubber, a urethane rubber, a silicone rubber, a fluorosilicone rubber, a fluororubber, and a liquid fluoroelastomer. The heat resistant rubber is preferably an elastic rubber having a siloxane bond as a main chain, and more preferably a silicone rubber from a viewpoint of heat resistance. The heat resistant rubber may be used singly or in combination of two or more types thereof.

The elastic layer preferably has a thickness of 50 to 500 μm, for example, from a viewpoint of sufficiently exhibiting followability to a recording medium and heat transferability. In a case where the thickness of the elastic layer is less than 50 m, followability to unevenness of paper may be insufficient. Meanwhile, in a case where the thickness of the elastic layer is more than 500 μm, heat transferability may be deteriorated because time to accumulate a heat amount necessary for fixing a toner image is required.

The elastic layer may further contain a component other than an elastic resin material within a range where the effect of the present embodiment can be obtained. For example, the elastic material may further contain a heat transferable filler for enhancing heat transferability of the elastic layer. Examples of the heat transferable filler include silica, metal silica, alumina, zinc, aluminum nitride, boron nitride, silicon nitride, silicon carbide, carbon, and graphite. The form of the heat transferable filler is not particularly limited, but is preferably, for example, spherical powder, amorphous powder, flat powder, or a fiber.

The content of the elastic resin material in the elastic material is, for example, preferably 60 to 100% by volume, more preferably 75 to 100% by volume, and still more preferably 80 to 100% by volume from a viewpoint of achieving both heat transferability and elasticity.

Next, a method for manufacturing the intermediate transfer body will be described.

[Method for Manufacturing Intermediate Transfer Body]

The method for manufacturing the intermediate transfer belt according to an embodiment of the present invention includes a step of applying a coating liquid having a viscosity within a range of 0.5 to 10 mPa·s at 20° C. to an outer peripheral surface of a substrate while rotating the substrate using a plurality of nozzles to form a surface layer (hereinafter, also referred to as a "surface layer forming step").

(Surface Layer Forming Step)

The surface layer forming step includes a step of preparing a substrate and a surface layer forming coating liquid according to an embodiment of the present invention (preparation step), and a step of applying the surface layer forming coating liquid (applying step), and preferably further includes a step of irradiating a coating film obtained by the surface layer forming coating liquid with an actinic ray (actinic ray irradiation step) or a step of thermosetting the coating film (thermosetting step).

(Preparation Step)

As the substrate and the surface layer forming coating liquid, those described above can be used. The surface layer forming coating liquid preferably has a viscosity within a range of 0.5 to 10 mPa·s at 20° C. The viscosity is more preferably within a range of 0.5 to 5.0 mPa·s at 20° C. This is because a uniform film can be formed by setting the viscosity within the range. Adjustment to the above viscosity can be performed by appropriately selecting the above-described resin, a metal oxide particle, a solvent, and the like.

(Applying Step)

The applying step includes a step of applying the surface layer forming coating liquid to an outer peripheral surface of the substrate layer while rotating the substrate layer using nozzles to form a surface layer. The number of nozzles used in the applying step is not particularly limited as long as being two or more. The number of nozzles used in the applying step is preferably within a range of 2 to 5. This is because a uniform film can be formed. These nozzles are disposed above one end of the substrate in a traveling direction thereof and in a width direction of the substrate (a direction of a rotation axis of a roller or a rotary body described later). These nozzles reciprocatedly moves in parallel in a width direction of the substrate. The travel speed of the nozzles is preferably within a range of 8.0 to 10.0 mm/sec. This is because a seamless film having no joint can be formed.

For rotating the substrate, for example, a plurality of rollers and a cylindrical rotary body described later are used. A rotary drive device is connected to the plurality of rollers and the cylindrical rotary body. In a case where the plurality of rollers is used, the plurality of rollers is disposed at both ends of the substrate which is an endless belt, a tension is applied to the substrate to hold the substrate, and the substrate can be rotated according to rotation of the rollers. In a case where a cylindrical rotary body is used, the substrate which is an endless belt is disposed on an outer peripheral surface of the rotary body, and the substrate can be rotated according to rotary operation of the rotary body.

The surface layer is preferably formed so as to have a thickness within a range of 2.0 to 8.0 μm from a viewpoint of improving mechanical strength and transferability.

(Actinic Ray Irradiation Step)

In a case where the surface layer forming coating liquid contains a photocurable resin, a coating film on the substrate is irradiated with an actinic ray. The coating film is irradiated with an actinic ray in order to photopolymerize a photopolymerizable monomer to form a surface layer. At this time, by irradiating the coating film with an actinic ray while rotating the substrate, the photopolymerizable monomer can be photopolymerized while suppressing a rise in the temperature of the substrate and suppressing a change in the crystallinity of the substrate. The irradiation energy, the number of times of irradiation, the irradiation time, and the like of an actinic ray can be appropriately set according to output of a light source, the type of photopolymerizable monomer, and the like.

The irradiation light amount of the actinic ray is preferably 500 mJ/cm$^2$ or more, more preferably within a range of 1000 to 5000 mJ/cm$^2$, and still more preferably within a range of 1000 to 2000 mJ/cm$^2$ from viewpoints of uneven curing, hardness, curing time, curing speed, and the like of the coating film. The irradiation light amount can be measured by, for example, UIT 250 (manufactured by Ushio Electric Co., Ltd.). The coating film is preferably irradiated with an ultraviolet ray from a UV-LED light source device from a viewpoint of reducing heat supplied to the substrate.

The irradiation time of an actinic ray is preferably 0.5 seconds to 5 minutes, and more preferably 3 seconds to 2 minutes from viewpoints of the curing efficiency of the coating film, working efficiency, and the like.

The oxygen concentration in the atmosphere when the coating film is irradiated with an actinic ray is preferably 5% or less, and more preferably 1% or less from viewpoints of uneven curing, curing time (curing efficiency), and the like of the coating film. The oxygen concentration can be adjusted, for example, by introducing nitrogen gas into the atmosphere using a purge device. The oxygen concentration can be measured, for example, with an atmosphere gas management oximeter "OX100" (manufactured by Yokogawa Electric Corporation).

(Thermosetting Step)

In a case where the surface layer forming coating liquid contains a thermosetting resin, a coating film on the substrate is thermoset by a drying device.

[Intermediate Transfer Body Manufacturing Device]

(Configuration of Manufacturing Device)

Figure 2:
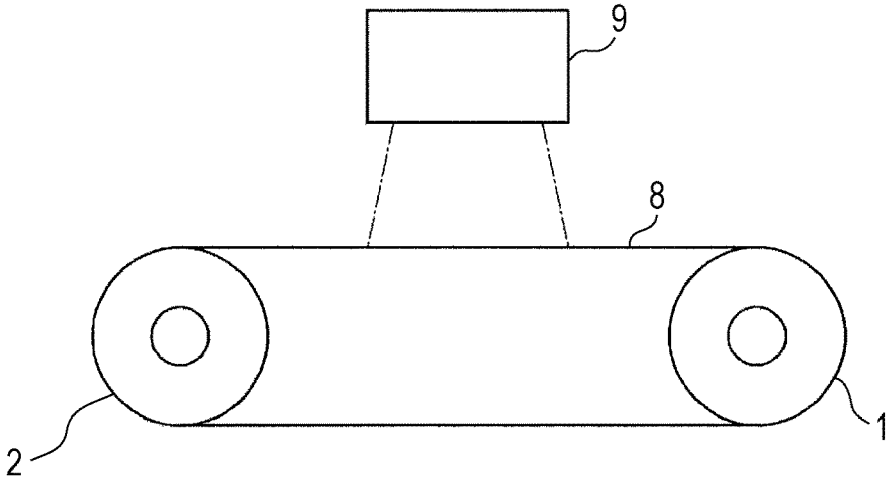
FIG. 2 is a schematic view illustrating a part of the intermediate transfer belt manufacturing device according to the embodiment.
Figure 3A:
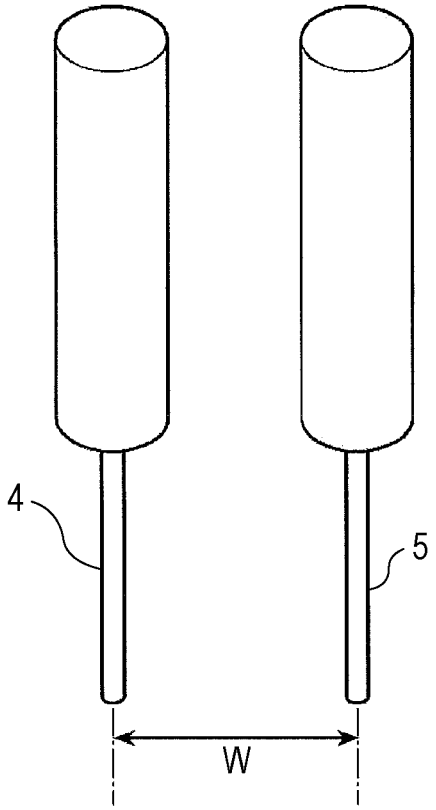
FIG. 3A is a schematic side view of nozzles included in the manufacturing device of FIGS. 1 and 2.
Figure 3B:
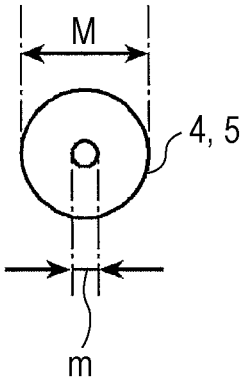
FIG. 3B is a bottom view of the nozzles used.

FIGS. 1 and 2 are schematic views each illustrating a part of the intermediate transfer body manufacturing device according to the embodiment. The intermediate transfer body manufacturing device (hereinafter, also simply referred to as "manufacturing device") according to the embodiment is a device for manufacturing an intermediate transfer body having at least a substrate and a surface layer. As illustrated in FIGS. 1 and 2, the manufacturing device includes a plurality of rollers 1 and 2, a rotary drive device 3, a plurality of nozzles 4 and 5, and an actinic ray irradiation device 6 or a drying device (not illustrated). The manufacturing device includes a purge device (not illustrated) as needed. FIG. 3A is a schematic side view of nozzles included in the manufacturing device of FIGS. 1 and 2. FIG. 3B is a bottom view of the nozzles included in the manufacturing device of FIGS. 1 and 2.

As illustrated in FIG. 1, each of the plurality of rollers 1 and 2 is disposed at each end of a substrate 8 which is an endless belt, and holds and rotatably supports the substrate 8. At least one of the plurality of rollers 1 and 2 is connected to the rotary drive device 3. In the embodiment, the number of the rollers 1 and 2 is two, and one roller 1 is connected to the rotary drive device 3 to be rotated and used as a driving roller 1. The substrate 8 rotationally moves according to rotary operation of the driving roller 1. The other roller 2 is a driven roller 2 that rotates and operates according to rotational movement of the substrate 8.

The outer diameters of the rollers 1 and 2 are preferably within a range of 60 to 120 mm. This is because within such a range, the bending ratio of a portion of the substrate 8 on each of the rollers does not increase at the time of manufacturing the intermediate transfer body, and creep hardly occurs. The outer diameters of the rollers may be the same as or different from each other. In the embodiment, the outer diameters of the two rollers 1 and 2 are the same as each other. The rotational speeds of the rollers 1 and 2 are preferably within a range of 750 to 1500 mm/sec.

The length of the substrate 8 (length in a traveling direction X) is preferably within a range of 250 to 500 mm, and the width of the substrate 8 (length in a width direction Y) is preferably within a range of 300 to 500 mm in view of deflection accuracy and meandering at the time of rotation of the belt.

The rotary drive device 3 transmits power to at least one of the rollers 1 and 2 to rotationally drive at least one of the rollers 1 and 2. As a result, the manufacturing device according to the embodiment can move the substrate 8 pivotally supported by the rollers 1 and 2 on an endless orbit. The rotary drive device 3 includes components such as a motor 6, a gear, and a power transmission belt 7. In the embodiment, components such as the motor 6 and a gear are connected to one driving roller 1 via the power transmission belt 7. The driven roller 2 not connected to the rotary drive device 3 rotates following rotation of the driving roller 1 connected to the rotary drive device 3.

In a case where the surface layer forming coating liquid contains a photocurable resin, an actinic ram irradiation device 9 illustrated in FIG. 2 emits an actinic ray for photopolymerizing the photocurable resin contained in the coating film. The actinic ray irradiation device 9 is disposed at a position where a coating film on the substrate 8 pivotally supported by the rollers 1 and 2 is irradiated with an actinic ray (above the substrate 8).

The actinic ray irradiation device 9 irradiates the entire area of the substrate 8 in a width direction thereof with an actinic ray. The actinic ray is an electromagnetic wave that photocures the coating film, and is, for example, an ultraviolet ray, an electron ray, or a γ ray. The actinic ray is preferably an ultraviolet ray or an electron ray, and more preferably an ultraviolet ray from a viewpoint that handling is easy and high energy can be easily obtained.

Examples of the type of a light source of the actinic ray include a low pressure mercury lamp, a medium pressure mercury lamp, an extra high pressure mercury lamp, a carbon arc lamp, a metal halide lamp, a xenon lamp, a flash (pulse) xenon, and a UV-LED. The actinic ray irradiation device 9 is preferably a UV-LED irradiation device including a UV-LED as a light source from a viewpoint of suppressing heat supplied to the substrate 8 and suppressing a decrease in flexibility and occurrence of creep in the intermediate transfer body.

In a case where the surface layer forming coating liquid contains a thermosetting resin, a coating film is heated with a drying device in order to cure the thermosetting resin contained in the coating film. In this case, the heating temperature in the drying device is preferably within a range of 200 to 450° C. in a case where the substrate 8 contains a polyimide resin or a polyamide resin, and preferably within a range of 30 to 60° C. in a case where the substrate 8 contains a polyphenylene sulfide resin.

The purge device supplies an inert gas such as a nitrogen gas or a rare gas to the atmosphere above the substrate 8 to adjust an oxygen concentration. The purge device supplies a nitrogen gas and is preferably disposed adjacent to the actinic ray irradiation device 9.

As illustrated in FIGS. 3A and 3B, an inner diameter m of each of the nozzles 4 and 5 is preferably within a range of 0.2 to 0.4 mm, and an outer diameter M of each of the nozzles 4 and 5 is preferably within a range of 1.0 to 1.2 mm in view of liquid dripping and liquid sucking up. Here, the inner diameter m of each of the nozzles 4 and 5 corresponds to a wet spreading width of a coating liquid discharged from the nozzles 4 and 5, and a center-to-center distance W of the nozzles is determined according to the wet spreading width. If the center-to-center distance W of the nozzles is too short, a coating liquid discharged from one nozzle 4 and a coating liquid discharged from the other nozzle 5 adjacent to the nozzle 4 overlap with each other. If the center-to-center distance W of the nozzles is too long, the coating liquids are not connected to each other, and therefore a joint is formed. Therefore, a ratio (nm/W) between the inner diameter m of each of the nozzles 4 and 5 and the center-to-center distance W of the nozzles is preferably within the following range.

In the present invention, the ratio (m/W) between the nozzle inner diameter m and the center-to-center distance W of the nozzles adjacent to each other is preferably within a range of 0.05 to 0.10. As described above, by setting the ratio (m/W) between the nozzle inner diameter m and the center-to-center distance W of the nozzles within the above range, a coating liquid discharged from the nozzles 4 and 5 lands on the substrate and causes wet spreading while rotating, and it is possible to shorten time until the coating liquid is connected to a coating liquid that is discharged next from the nozzles and lands on the substrate without changing the rotational speed of the substrate. Therefore, a seamless and uniform thin film can be formed.

The flow rate per nozzle is preferably within a range of 3 to 10 mL/min, and more preferably within a range of 3.0 to 5.0 mL/min.

The plurality of nozzles 4 and 5 applies the surface layer forming coating liquid to an outer peripheral surface of the substrate 8. In the embodiment, the device includes the two nozzles 4 and 5. The two nozzles 4 and 5 are disposed above one end of the substrate 8 in the traveling direction X of the substrate 8 and in the width direction Y of the substrate 8 (a direction of rotation axes of the rollers 1 and 2). Specifically, the two nozzles 4 and 5 are supported by a rail or the like (not illustrated) and driven by a drive unit (not illustrated) to reciprocatedly move in parallel in the width direction Y of the substrate 8. That is, the nozzles 4 and 5 travel in the direction Y orthogonal to the traveling direction X by rotation of the substrate 8. Note that the traveling speed of each of the nozzles 4 and 5, the flow rate per nozzle, the inner diameter m and the outer diameter M of each of the nozzles 4 and 5, and the nozzle inner diameter m/center-to-center distance W between the nozzles have been described above, and therefore description thereof is omitted here.

(Operation Procedure of Device)

First, the substrate 8 that is an endless belt is disposed on the rollers 1 and 2. Specifically, the substrate 8 is bridged between the two rollers 1 and 2 and is supported by the rollers 1 and 2. Subsequently, the driving roller 1 is rotated by driving the rotary drive device 3, and the substrate 8 bridged between the driving roller 1 and the driven roller 2 circulatedly moves between the driving roller 1 and the driven roller 2. In this manner, the driving roller 1 is rotationally driven to move the substrate 8 on the endless orbit.

Subsequently, the surface layer forming coating liquid is applied to the rotationally moving substrate 8 using the nozzles 4 and 5. Specifically, the surface layer forming coating liquid is discharged onto the rotationally moving substrate 8 from each of the nozzles 4 and 5 while the two nozzles 4 and 5 are moved from one side end on the substrate 8 in the width direction Y to the other side end. The coating liquid is discharged onto an outer peripheral surface of the rotationally moving substrate 8 in this manner while the nozzles 4 and 5 travel, and a single spiral coating film is thereby formed by the coating liquid discharged from one of the nozzles. In the embodiment, since the coating liquid is discharged from each of the two nozzles 4 and 5, two spiral coating films are formed by the two coating liquids, and these two coating films cause wet spreading before being dried and are connected to each other. Therefore, a seamless coating film can be obtained as a result.

As described above, a coating film is formed on the entire outer peripheral surface of the substrate 8 by the nozzles 4 and 5. Thereafter, in a case where the coating film contains a photocurable resin, the coating film is irradiated with an actinic ray. In a case where the coating film contains a thermosetting resin, the substrate 8 is carried into a drying device, and the thermosetting resin is thermoset.

With regard to the irradiation with an actinic ray, specifically, by irradiating the coating film with an actinic ray while rotationally moving the substrate 8, the photopolymerizable monomer can be photopolymerized while suppressing a rise in the temperature of the substrate 8 and suppressing a change in the crystallinity of the substrate 8. The irradiation energy, the number of times of irradiation, the irradiation time, and the like of an actinic ray can be appropriately set according to output of a light source, the type of photopolymerizable monomer, and the like.

The irradiation light amount of the actinic ray is preferably 500 $mJ/cm^2$ or more, more preferably within a range of 1000 to 5000 $mJ/cm^2$, and still more preferably within a range of 1000 to 2000 $mJ/cm^2$ from viewpoints of uneven curing, hardness, curing time, curing speed, and the like of the coating film. The irradiation light amount can be measured, for example, with UIT 250 (manufactured by Ushio Electric Co., Ltd.). As described above, the coating film is preferably irradiated with an ultraviolet ray from a UV-LED light source device from a viewpoint of reducing heat supplied to the substrate.

The irradiation time of an actinic ray is preferably 0.5 seconds to 5 minutes, and more preferably 3 seconds to 2 minutes from viewpoints of the curing efficiency of the coating film, working efficiency, and the like.

The oxygen concentration in the atmosphere when the coating film is irradiated with an actinic ray is preferably 5% or less, and more preferably 1% or less from viewpoints of uneven curing, curing time (curing efficiency), and the like of the coating film. The oxygen concentration can be adjusted, for example, by introducing nitrogen gas into the atmosphere using a purge device. The oxygen concentration can be measured, for example, with an atmosphere gas management oximeter "OX100" (manufactured by Yokogawa Electric Corporation).

With regard to thermosetting, specifically, the substrate 8 is carried into a drying device, and the coating film is heated to cure a thermosetting resin contained in the substrate 8.

[Image Forming Device]

An image forming device according to an embodiment of the present invention includes an intermediate transfer body for transferring a toner image formed on a photoreceptor onto a recording medium. Here, examples of the recording media include plain paper including thin paper and cardboard, printing paper including art paper and coated paper, Japanese paper, postcard paper, a plastic film for OHP, and cloth.

Figure 4:
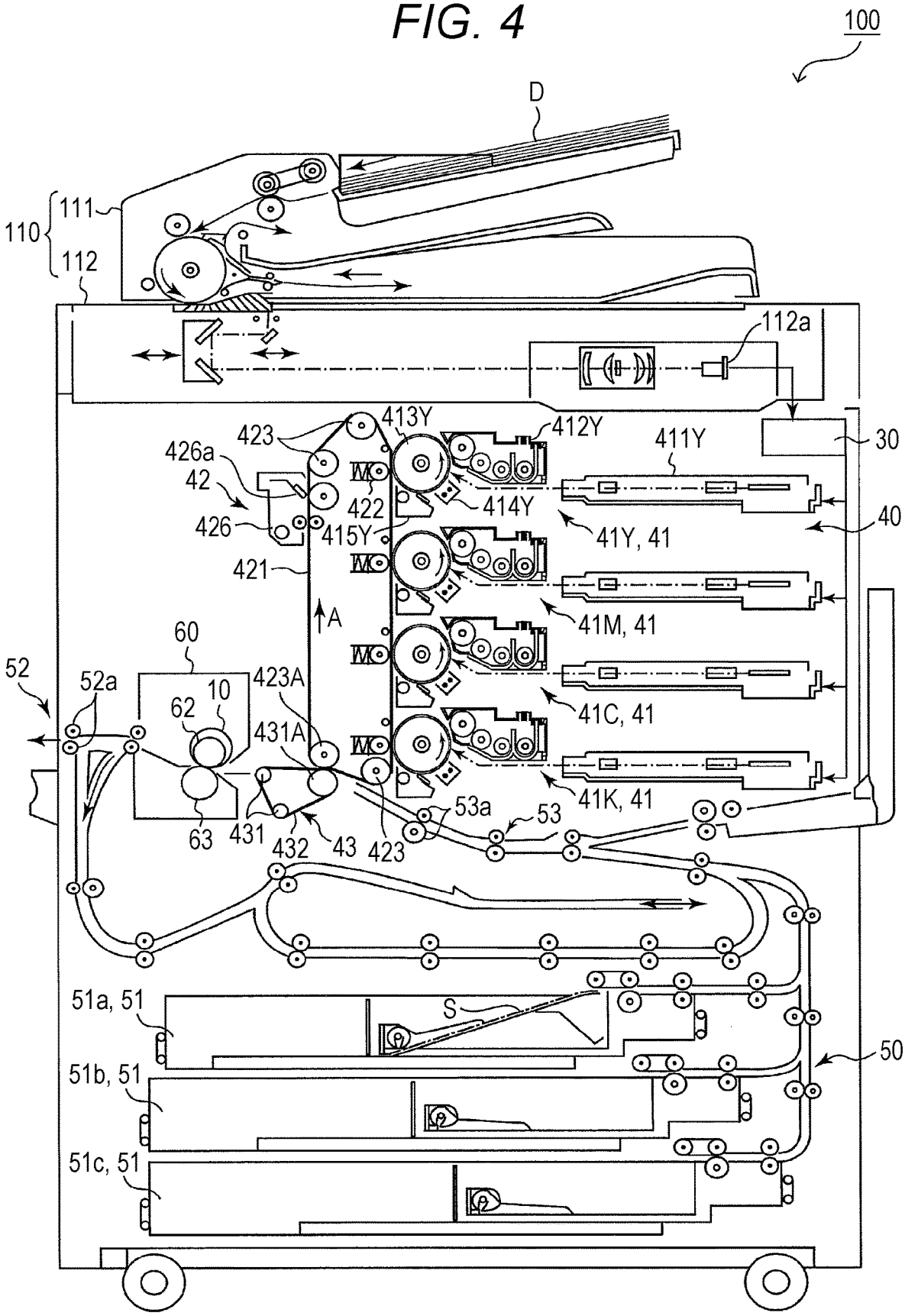
FIG. 4 is a view schematically illustrating a configuration of an image forming device including an intermediate transfer body according to the embodiment.

FIG. 4 is a view schematically illustrating an example of a configuration of the image forming device. An image forming device 100 illustrated in FIG. 4 includes an image reader 110, an image processor 30, an image former 40, a sheet conveyor 50, and a fixing device 60.

The image former 40 includes image forming units 41Y, 41M, 41C, and 41K that form images using toners of yellow (Y), magenta (M), cyan (C), and black (K), respectively. These units have the same configuration except for a toner to be housed therein, and therefore symbols representing colors may be omitted below. The image former 40 further includes an intermediate transfer unit 42 and a secondary transfer unit 43. These units correspond to a transfer device.

The image forming unit 41 includes an exposing device 411, a developing device 412, an image carrier 413, a charging device 414, and a drum cleaning device 415. The charging device 414 is, for example, a corona charger. The charging device 414 may be a contact charging device that charges a contact charging member such as a charging roller, a charging brush, or a charging blade in contact with the image carrier 413. The exposing device 411 includes, for example, a semiconductor laser as a light source and a light deflecting device (polygon motor) that emits a laser according to an image to be formed toward the image carrier 413. The developing device 412 is a two-component developing type developing device and houses a two-component developer.

The intermediate transfer unit 42 includes an intermediate transfer body 421, a primary transfer roller 422 that presses the intermediate transfer body 421 against the image carrier 413, a plurality of support rollers 423 including a backup roller 423A, and a belt cleaning device 426.

The intermediate transfer body 421 is formed by a substrate layer and a surface layer having the above-described configuration. The belt cleaning device 426 includes an elastic cleaning blade 426*a* in contact with the intermediate transfer body 421. The intermediate transfer body 421 is stretched in a loop shape by the plurality of support rollers 423. By rotation of at least one driving roller of the plurality of support rollers 423, the intermediate transfer body 421 travels at a constant speed in a direction of arrow A.

The secondary transfer unit 43 includes an endless secondary transfer belt 432 and a plurality of support rollers 431 including a secondary transfer roller 431A. The secondary transfer belt 432 is stretched in a loop shape by the secondary transfer roller 43 IA and the support rollers 431.

The fixing device 60 includes, for example, a fixing roller 62, an endless heat generating belt 10 for coating an outer peripheral surface of the fixing roller 62 and heating and melting toner constituting a toner image on a sheet S, and a pressure roller 63 that presses the sheet S against the fixing roller 62 and the heat generating belt 10. The sheet S corresponds to a recording medium.

The image reader 110 includes a sheet feeding device 111 and a scanner 112. The sheet conveyor 50 includes a sheet feeder 51, a sheet discharger 52, and a conveying path 53. Three sheet feeding tray units 51*a* to 51*c* constituting the sheet feeder 51 house the sheets S (standard sheet and special sheet) identified based on basis weight, size, and the like according to the type set in advance. The conveying path 53 includes a plurality of conveying roller pairs such as a resist roller pair 53*a*.

Formation of an image by the image forming device 100 will be described.

The scanner 112 optically scans and reads a document D on a contact glass. Reflected light from the document D is read by a CCD sensor 112*a* and becomes input image data. The input image data is subjected to predetermined image processing in the image processor 30 and sent to the exposing device 411.

The image carrier 413 rotates at a constant peripheral speed. The charging device 414 negatively charges a surface of the image carrier 413 uniformly. In the exposing device 411, a polygon mirror of the polygon motor rotates at a high speed, a laser corresponding to input image data of each color component develops in an axial direction of the image carrier 413, and an outer peripheral surface of the image carrier 413 is irradiated with the laser in the axial direction. In this way, an electrostatic latent image is formed on the surface of the image carrier 413.

In the developing device 412, the two-component developer in the developing container is stirred and conveyed to charge toner particles, conveyed to a developing roller, and forms a magnetic brush on a surface of the developing roller. The charged toner particles electrostatically adhere to an electrostatic latent image portion on the image carrier 413 from the magnetic brush. In this way, the electrostatic latent image on the surface of the image carrier 413 is visualized, and a toner image corresponding to the electrostatic latent image is formed on the surface of the image carrier 413. Note that the "toner image" refers to a state in which toner is aggregated in an image shape.

When the image carrier 413 rotates, the toner image on the surface of the image carrier 413 moves to a primary transfer area where the image carrier 413 is in contact with the intermediate transfer body 421. A negative voltage is applied to the intermediate transfer body 421 by a power supply (not illustrated), and the intermediate transfer body 421 is charged to a predetermined surface potential. A toner moves by an electric field generated by the applied voltage, and the toner image on the surface of the image carrier 413 is thereby primarily transferred onto a surface of the intermediate transfer body 421. After the primary transfer, a liquid developer remaining on the image carrier 413 is removed by the belt cleaning device 426, and the surface of the image carrier 413 is uniformly charged again to a predetermined surface potential by the charging device 414.

The primary transfer roller 422 presses the intermediate transfer body 421 against the image carrier 413. As a result, a primary transfer nip is formed for each image carrier by the image carrier 413 and the intermediate transfer body 421. At the primary transfer nip, a toner image of each color is sequentially superposed and transferred onto the intermediate transfer body 421.

Meanwhile, the secondary transfer roller 431A is pressed against the backup roller 423A via the intermediate transfer body 421 and the secondary transfer belt 432. As a result, a secondary transfer nip is formed by the intermediate transfer body 421 and the secondary transfer belt 432. The sheet S passes through the secondary transfer nip. The sheet S is conveyed to the secondary transfer nip by the sheet conveyor 50. Correction of an inclination of the sheet S and adjustment of the timing of conveyance are performed by a resist roller unit having the resist roller pair 53*a* disposed therein.

When the sheet S is conveyed to the secondary transfer nip, a transfer bias is applied to the secondary transfer roller 431A. By application of this transfer bias, a toner image carried on the intermediate transfer body 421 is transferred onto the sheet S. The sheet S onto which the toner image has been transferred is conveyed toward the fixing device 60 by the secondary transfer belt 432.

A full-color toner image formed on the surface of the intermediate transfer body 421 moves to the secondary transfer area where the intermediate transfer body 421 is in contact with the sheet S by rotation of the intermediate transfer body 421 in the arrow direction. In the secondary transfer area, while a linear pressure is applied to a space between the intermediate transfer body 421 and the sheet S by the secondary transfer roller 431A on the back side of the sheet S, a negative voltage is applied to the secondary transfer roller 43 IA by a power supply (not illustrated). At this time, the surface of the intermediate transfer body 421 is also charged to a predetermined surface potential. By application of this voltage, a surface of the sheet S facing the intermediate transfer body 421 also has a negative potential. The toner image is attracted to a surface of the sheet S by a potential difference between the surface potential of the sheet S and the surface potential of the intermediate transfer body 421. In this state, the sheet S is conveyed in the arrow direction and comes out of the secondary transfer area to complete the secondary transfer of the toner image onto the sheet S. The sheet S onto which the toner image has been transferred is fixed by the fixing roller 62 to complete image output. The sheet S to which the toner image has been fixed is discharged to the outside of the device by the sheet discharger 52 having a discharge roller 52*a*.

Note that a transfer residual tone remaining on a surface of the intermediate transfer body 421 after the secondary transfer is removed by the cleaning blade 426*a*. The surface layer of the intermediate transfer body 421 is abraded by friction with the cleaning blade 426*a*. However, as described above, since the intermediate transfer body 421 has a surface layer that has been uniformly cured in a surface direction thereof, the intermediate transfer body 421 is abraded uniformly by friction with the cleaning blade 426*a* to prevent uneven abrasion. Therefore, desired transfer performance by the intermediate transfer body 421 is exhibited over a long period of time, and occurrence of transfer failure due to uneven abrasion and image failure resulting therefrom is suppressed over a long period of time.

EXAMPLES

The present invention will be described more specifically using the following tests. Note that the present invention is not limited to the following tests.

[Preparation of Substrate Layer]

The following components were put in the following amounts in a single screw extruder and melt-kneaded to prepare a resin mixture.

Resin: 100 parts by volume

Conductive filler: 16 parts by volume

Dispersant: 1 part by volume

Lubricant: 0.2 parts by volume

The resin is polyphenylene sulfide (PPS), Torelina E2180 (manufactured by Toray Industries. Inc.). The conductive filler is carbon black, Furnace #3030B (manufactured by Mitsubishi Chemical Corporation) that imparts an electric resistance value to a substrate layer. The dispersant is ModiperA4400 (manufactured by NOF CORPORATION) that imparts impact resistance to an engineering plastic and functions as a pigment dispersant. The lubricant is calcium montanate. Celidast 5551 (manufactured by Clariant International Ltd.). For melt-kneading, a single screw kneading extruder "IPM-65" (manufactured by CTE Co., Ltd.) was used.

The above resin mixture was dried at 130° C. for eight hours and melted with a 40 mm diameter extruder equipped with a 6-strip spiral annular die having a diameter of 150 mm and a lip width of 1 mm. Subsequently, an annular die having a slit-shaped and seamless belt-shaped discharge port was attached to a tip of the single screw extruder and the kneaded resin mixture was extruded into a seamless belt shape. The extruded seamless belt-shaped resin mixture was extrapolated to a cylindrical cooling cylinder disposed at a discharge destination and cooled to be solidified, and a substrate layer having a thickness of 120 μm, a peripheral length of 750 mm, and a width of 359 mm was thereby prepared.

[Preparation of Surface Layer]

(Metal Oxide Fine Particles 1)

Metal oxide fine particles 1 are tin oxide fine particles. With respect to 100 parts by volume of Nanotek $SnO_2$ (number average primary particle diameter: 34 nm, manufactured by CIK Nanotek Corporation), 1 part by volume of 3-methacryloxypropyl trimethoxysilane (KBM-503, manufactured by Shin-Etsu Chemical Co., Ltd.) as a surface modifier, and 200 parts by volume of a solvent (mixed solvent of toluene:isopropyl alcohol=1:1 (volume ratio)) were mixed. Subsequently, the mixture was dispersed in a wet media dispersion device for one hour, and then the solvent was removed. Finally, the mixture was dried at 150° C. for 30 minutes to obtain surface-treated metal oxide fine particles 1.

(Metal Oxide Fine Particles 2)

Surface-treated metal oxide fine particles 2 were obtained in a similar manner to the metal oxide fine particles 1 except that KBM-503 was changed to KBM-1003 (vinyltrimethoxysilane, manufactured by Shin-Etsu Chemical Co., Ltd.).

(Metal Oxide Fine Particles 3)

Surface-treated metal oxide fine particles 3 were obtained in a similar manner to the metal oxide fine particles 1 except that KBM-503 was changed to KBM-5803 (methacryloxyoctyl trimethoxysilane, manufactured by Shin-Etsu Chemical Co., Ltd.).

(Metal Oxide Fine Particles 4)

Surface-treated metal oxide fine particles 4 were obtained in a similar manner to the metal oxide fine particles 1 except that KBM-503 was changed to methyl hydrogen polysiloxane (MHPS) (product name: KF-9901, manufactured by Shin-Etsu Chemical Co., Ltd.).

(Metal Oxide Fine Particles 5)

Silicon nitride that had not been subjected to a surface treatment was used as metal oxide fine particles 5.

Table 1 illustrates configurations of the metal oxide fine particles 1 to 5.

TABLE 1

| | Type | Surface treatment agent |
|---|---|---|
| Metal oxide fine particles 1 | Tin oxide | KBM-503 |
| Metal oxide fine particles 2 | Tin oxide | KBM-1003 |
| Metal oxide fine particles 3 | Tin oxide | KBM-5803 |
| Metal oxide fine particles 4 | Tin oxide | MHPS |
| Metal oxide fine particles 5 | Silicon nitride | — |

(Preparation of Coating Liquid 1)

85 parts by volumes of polyfunctional monomer A (EO modified (12) dipentaerythritol hexaacrylate: acryloyl group equivalent (184.5 g/eq)) (KAYARAD DPEA-12: manufactured by Nippon Kayaku Co., Ltd., "KAYARAD" is a registered trademark of Nippon Kayaku Co., Ltd), 15 parts by volume of surface-treated metal oxide fine particles 1, and 0.05 parts by volumes of a reactive fluorine-based surfactant (Megaface RS-75: manufactured by DIC Corporation, "Megaface" is a registered trademark of DIC Corporation) were dissolved in methyl isobutyl ketone (MIBK) such that the solid concentration was 10% by volume, and dispersed therein to prepare a diluted solution. Subsequently, 1 part by mass of a photopolymerization initiator (Irgacure OXE02 (ethanone, 1-[9-ethyl-6-(2-methylbenzoyl)-9H-carbazol-3-yl]-,1-(0-acetyl oxine)); manufactured by BASF SE) and 0.3 parts by mass of an additive (KAYACURE EPA (4-(dimethylamino) benzoic acid ethyl ester): manufactured by Nippon Kayaku Co., Ltd., "KAYACURE" is a registered trademark of Nippon Kayaku Co., Ltd.) were mixed with respect to 100 parts by mass of the diluted solution. Subsequently, the metal oxide fine particles 1 and the like were dispersed with an ultrasonic homogenizer "US-150AT" (manufactured by Nippon Seiki Seisakusho Co., Ltd.) to prepare a surface layer forming coating liquid 1.

(Preparation of Coating Liquid 2)

70 parts by volumes of polyfunctional monomer A (EO modified (12) dipentaerythritol hexaacrylate: acryloyl group equivalent (184.5 g/eq)) (KAYARAD DPEA-12: manufactured by Nippon Kayaku Co., Ltd.), 10 parts by volume of a monofunctional monomer in which an alkyl group had 18 carbon atoms (stearyl acrylate (SA), manufactured by NOF Corporation), 20 parts by volume of surface-treated metal oxide fine particles 1, and 0.05 parts by volumes of Megaface RS-75 were dissolved in MIBK such that the solid concentration was 10% by volume, and dispersed therein to prepare a diluted solution. Subsequently, Irgacure OXE02 (1 part by mass) and KAYACURE EPA (0.3 parts by mass) were mixed with respect to 100 parts by mass of the diluted solution. Subsequently, the metal oxide fine particles 1 and the like were dispersed with an ultrasonic homogenizer to prepare a surface layer forming coating liquid 2.

(Preparation of Coating Liquid 3)

A surface layer forming coating liquid 3 was prepared in a similar manner to the coating liquid 2 except that the blending amount of the polyfunctional monomer A was changed from 70 parts by volume to 60 parts by volume, and that the blending amount of the monofunctional monomer was changed from 10 parts by volume to 20 parts by volume.

(Preparation of Coating Liquid 4)

A surface layer forming coating liquid 4 was prepared in a similar manner to the coating liquid 2 except that the reactive fluorine-based surfactant was changed from Megaface RS-75 to Megaface RS-76-E.

(Preparation of Coating Liquid 5)

A surface layer forming coating liquid 5 was prepared in a similar manner to the coating liquid 2 except that the reactive fluorine-based surfactant was changed from Megaface RS-75 to Megaface RS-78.

(Preparation of Coating Liquid 6)

A surface layer forming coating liquid 6 was prepared in a similar manner to the coating liquid 2 except that the reactive fluorine-based surfactant was changed from Megaface RS-75 to Megaface RS-78 and that the addition amount thereof was changed from 0.05 parts by volumes to 0.20 parts by volumes.

(Preparation of Coating Liquid 7)

A surface layer forming coating liquid 7 was prepared in a similar manner to the coating liquid 2 except that the reactive fluorine-based surfactant was changed from Megaface RS-75 to Megaface RS-90.

(Preparation of Coating Liquid 8)

A surface layer forming coating liquid 8 was prepared in a similar manner to the coating liquid 2 except that the reactive fluorine-based surfactant was changed from Megaface RS-75 to Fluorolink AD 1700 (manufactured by Solvay Specialty Polymers Co., Ltd., "Fluorolink" is a registered trademark of Solvay Specialty Polymers Co., Ltd.) and that the addition amount thereof was changed from 0.05 parts by volumes to 0.10 parts by volumes.

(Preparation of Coating Liquid 9)

A surface layer forming coating liquid 9 was prepared in a similar manner to the coating liquid 2 except that the metal oxide fine particles 1 were changed to the metal oxide fine particles 2.

(Preparation of Coating Liquid 10)

A surface layer forming coating liquid 10 was prepared in a similar manner to the coating liquid 2 except that the metal oxide fine particles 1 were changed to the metal oxide fine particles 3.

(Preparation of Coating Liquid 11)

A surface layer forming coating liquid 11 was prepared in a similar manner to the coating liquid 2 except that the metal oxide fine particles 1 were changed to the metal oxide fine particles 4.

(Preparation of Coating Liquid 12)

A surface layer forming coating liquid 12 was prepared in a similar manner to the coating liquid 2 except that the monofunctional monomer in which an alkyl group had 18 carbon atoms was changed to a monofunctional monomer in which an alkyl group had 12 carbon atoms.

(Preparation of Coating Liquid 13)

A surface layer forming coating liquid 13 was prepared in a similar manner to the coating liquid 2 except that the blending amount of the polyfunctional monomer A was changed from 70 parts by volume to 76 parts by volume and that the blending amount of the monofunctional monomer was changed from 10 parts by volume to 4 parts by volume.

(Preparation of Coating Liquid 14)

A surface layer forming coating liquid 14 was prepared in a similar manner to the coating liquid 2 except that the metal oxide fine particles 1 were changed to the metal oxide fine particles 5.

(Preparation of Coating Liquid 15)

A surface layer forming coating liquid 15 was prepared in a similar manner to the coating liquid 2 except that the polyfunctional monomer A was changed to a polyfunctional monomer B (A-DPH-6PA (PO modified (6) dipentaerythritol hexaacrylate): acryloyl group equivalent (154.5 g/eq): manufactured by Shin-Nakamura Chemical Co., Ltd.).

(Preparation of Coating Liquid 16)

A surface layer forming coating liquid 16 was prepared in a similar manner to the coating liquid 2 except that the polyfunctional monomer A was changed to a polyfunctional monomer C (PO modified (4) pentaerythritol tetraacrylate): acryloyl group equivalent (146.2 g/eq)) (ATM-4P: manufactured by Shin-Nakamura Chemical Co., Ltd.).

(Preparation of Coating Liquid 17)

A surface layer forming coating liquid 17 was prepared in a similar manner to the coating liquid 2 except that the polyfunctional monomer A was changed to a polyfunctional monomer D (PO modified (3) trimethylolpropane triacrylate: acryloyl group equivalent (156.9 g/eq)) (A-TMPT-30: manufactured by Shin-Nakamura Chemical Co., Ltd.)

(Preparation of Coating Liquid 18)

A surface layer forming coating liquid 18 was prepared in a similar manner to the coating liquid 2 except that the polyfunctional monomer A was changed to a polyfunctional monomer E (dipentaerythritol hexaacrylate (DPHA): acryloyl group equivalent (94.5 g/eq): manufactured by Nippon Kayaku Co., Ltd.).

(Preparation of Coating Liquid 19)

A surface layer forming coating liquid 19 was prepared in a similar manner to the coating liquid 2 except that the polyfunctional monomer A was changed to a polyfunctional monomer F (pentaerythritol tetraacrylate (PETA): acryloyl group equivalent (86.1 g/eq): manufactured by Toagosei Co., Ltd.).

(Preparation of Coating Liquid 20)

A surface layer forming coating liquid 20 was prepared in a similar manner to the coating liquid 2 except that the polyfunctional monomer A was changed to a polyfunctional monomer G (SR9003 (PO modified (2) neopentyl glycol diacrylate): acryloyl group equivalent (164.2 g/eq): manufactured by Sartomer).

(Preparation of Coating Liquid 21)

A surface layer forming coating liquid 21 was prepared in a similar manner to the coating liquid 2 except that the reactive fluorine-based surfactant was changed from Megaface RS-75 to Megaface F-562 having no reactive group and that the addition amount thereof was changed from 0.05 parts by volumes to 0.10 parts by volumes.

(Preparation of Coating Liquid 22)

A surface layer forming coating liquid 22 was prepared in a similar manner to the coating liquid 2 except that the reactive fluorine-based surfactant was changed from Megaface RS-75 to Megaface F-562 and that the addition amount thereof was changed from 0.05 parts by volumes to 0.01 parts by volumes.

(Preparation of Coating Liquid 23)

A surface layer forming coating liquid 23 was prepared in a similar manner to the coating liquid 2 except that the polyfunctional monomer A was changed to the polyfunctional monomer B and that the type of reactive fluorine-based surfactant was changed from Megaface RS-75 to fluorine-free silicone oil (product name: KF-96-10cs, manufactured by Shin-Etsu Chemical Co., Ltd.).

(Preparation of Coating Liquid 24)

A surface layer forming coating liquid 24 was prepared in a similar manner to the coating liquid 2 except that the polyfunctional monomer A was changed to the polyfunctional monomer B and that the addition amount of Megaface RS-75 was changed from 0.05 parts by volume to 0.005 parts by volume.

(Preparation of Coating Liquid 25)

A surface layer forming coating liquid 25 was prepared in a similar manner to the coating liquid 2 except that the polyfunctional monomer A was changed to the polyfunctional monomer B, that Megaface RS-75 was changed to Megaface RS-90, and that the addition amount thereof was changed from 0.05 parts by volumes to 5.00 parts by volumes.

(Preparation of Coating Liquid 26)

A surface layer forming coating liquid 26 was prepared in a similar manner to the coating liquid 2 except that the polyfunctional monomer A was changed to the polyfunctional monomer B, that Megaface RS-75 was changed to DISPERBYK-118 (manufactured by BYK. "DISPERBYK" is a registered trademark of BYK), and that the addition amount thereof was changed from 0.05 parts by volume to 0.20 parts by volume.

Tables 2 and 3 illustrate formulations of the coating liquids 1 to 26.

TABLE 2

| | Polyfunctional monomer | | | Monofunctional monomer | | Reactive fluorine-based surfactant | | Metal oxide fine particles | |
|---|---|---|---|---|---|---|---|---|---|
| | Monomer | Number of functional groups | Parts by volume | Number of carbon atoms in alkyl group | Parts by volume | Type of surfactant | Parts by volume | Type | Parts by volume |
| Coating liquid 1 | A | 6 | 85 | — | — | RS-75 | 0.05 | Metal oxide fine particles 1 | 15 |
| Coating liquid 2 | A | 6 | 70 | 18 | 10 | RS-75 | 0.05 | Metal oxide fine particles 1 | 20 |
| Coating liquid 3 | A | 6 | 60 | 18 | 20 | RS-75 | 0.05 | Metal oxide fine particles 1 | 20 |
| Coating liquid 4 | A | 6 | 70 | 18 | 10 | RS-76-E | 0.05 | Metal oxide fine particles 1 | 20 |
| Coating liquid 5 | A | 6 | 70 | 18 | 10 | RS-78 | 0.05 | Metal oxide fine particles 1 | 20 |
| Coating liquid 6 | A | 6 | 70 | 18 | 10 | RS-78 | 0.20 | Metal oxide fine particles 1 | 20 |
| Coating liquid 7 | A | 6 | 70 | 18 | 10 | RS-90 | 0.05 | Metal oxide fine particles 1 | 20 |
| Coating liquid 8 | A | 6 | 70 | 18 | 10 | AD1700 | 0.10 | Metal oxide fine particles 1 | 20 |
| Coating liquid 9 | A | 6 | 70 | 18 | 10 | RS-75 | 0.05 | Metal oxide fine particles 2 | 20 |
| Coating liquid 10 | A | 6 | 70 | 18 | 10 | RS-75 | 0.05 | Metal oxide fine particles 3 | 20 |
| Coating liquid 11 | A | 6 | 70 | 18 | 10 | RS-75 | 0.05 | Metal oxide fine particles 4 | 20 |
| Coating liquid 12 | A | 6 | 70 | 12 | 10 | RS-75 | 0.05 | Metal oxide fine particles 1 | 20 |
| Coating liquid 13 | A | 6 | 76 | 18 | 4 | RS-75 | 0.05 | Metal oxide fine particles 1 | 20 |
| Coating liquid 14 | A | 6 | 70 | 18 | 10 | RS-75 | 0.05 | Metal oxide fine particles 5 | 20 |
| Coating liquid 15 | B | 6 | 70 | 18 | 10 | RS-75 | 0.05 | Metal oxide fine particles 1 | 20 |
| Coating liquid 16 | C | 4 | 70 | 18 | 10 | RS-75 | 0.05 | Metal oxide fine particles 1 | 20 |
| Coating liquid 17 | D | 3 | 70 | 18 | 10 | RS-75 | 0.05 | Metal oxide fine particles 1 | 20 |
| Coating liquid 18 | E | 6 | 70 | 18 | 10 | RS-75 | 0.05 | Metal oxide fine particles 1 | 20 |
| Coating liquid 19 | F | 4 | 70 | 18 | 10 | RS-75 | 0.05 | Metal oxide fine particles 1 | 20 |
| Coating liquid 20 | G | 2 | 70 | 18 | 10 | RS-75 | 0.05 | Metal oxide fine particles 1 | 20 |

(Applying Conditions)

TABLE 3

| | Polyfunctional monomer | | | Monofunctional monomer | | Reactive fluorine-based surfactant | | Metal oxide fine particles | |
|---|---|---|---|---|---|---|---|---|---|
| | Monomer | Number of functional groups | Parts by volume | Number of carbon atoms in alkyl group | Parts by volume | Type of surfactant | Parts by volume | Type | Parts by volume |
| Coating liquid 21 | A | 6 | 70 | 18 | 10 | F-562 | 0.10 | Metal oxide fine particles 1 | 20 |
| Coating liquid 22 | A | 6 | 70 | 18 | 10 | F-562 | 0.01 | Metal oxide fine particles 1 | 20 |
| Coating liquid 23 | B | 6 | 70 | 18 | 10 | Silicone oil | 0.05 | Metal oxide fine particles 1 | 20 |
| Coating liquid 24 | B | 6 | 70 | 18 | 10 | RS-75 | 0.005 | Metal oxide fine particles 1 | 20 |
| Coating liquid 25 | B | 6 | 70 | 18 | 10 | RS-90 | 5.00 | Metal oxide fine particles 1 | 20 |
| Coating liquid 26 | B | 6 | 70 | 18 | 10 | DISPERBYK-118 | 0.20 | Metal oxide fine particles 1 | 20 |

[Manufacture of Intermediate Transfer Body] (Intermediate Transfer Body 1)

A substrate layer was held by a biaxial roller. While the substrate layer was rotated, the surface layer forming coating liquid 1 was applied onto an outer peripheral surface of the substrate layer using two nozzles under the following applying conditions such that the dry film thickness thereof was 4 μm, thus forming a coating film. Subsequently, the coating film was dried naturally and then dried in a heating/drying furnace at 60° C. for 10 minutes. Finally, by irradiating the formed coating film with an ultraviolet ray as an actinic ray (active energy ray) under the following irradiation conditions, the coating film was cured to form a surface layer on the outer peripheral surface of the substrate layer, thus obtaining an intermediate transfer body 1. Note that the coating film was irradiated with an ultraviolet ray while a light source was fixed and the precursor having the coating film formed on an outer peripheral surface of the substrate layer was rotated at a peripheral speed of 10 mm/sec. A contact angle of the outer peripheral surface (surface layer) of the obtained intermediate transfer body 1 was measured under the following conditions, and the pure water contact angle was 79°.

Nozzle travel speed: 5.0 mm/sec

Rotational speed of substrate layer at the time of applying surface layer: 1000 mm/sec Nozzle inner diameter (m): 0.2 mm Nozzle outer diameter (m): 1 mm Number of nozzles: 2

Nozzle inner diameter (in)/center-to-center distance (L) between nozzles: 0.07

Nozzle flow rate: 5.0 ml/min (flow rate per nozzle)

Applying viscosity (20° C.): 1 mPa·s (Ultraviolet Ray Irradiation Conditions)

Wavelength: 365 nm

Type of light source: LED "SPV series (365 nm type)" (manufactured by Rebox)

Distance from irradiation port to surface of coating film: 40 mm

Atmosphere: nitrogen (oxygen concentration 500 ppm or less)

Irradiance: 100 mW/cm$^2$

Irradiation time (rotation time of substrate): 150 seconds (Measurement Conditions of Contact Angle)

A contact angle was measured according to JIS R 3257 (1999) using a portable contact angle meter "PCA-11" (manufactured by Kyowa Interface Science, Inc.).

(Intermediate Transfer Body 2)

An intermediate transfer body 2 was obtained in a similar manner to the intermediate transfer body 1 except that the coating liquid 1 was changed to the coating liquid 2. A surface layer of the obtained intermediate transfer body 2 had a pure water contact angle of 82°.

(Intermediate Transfer Body 3)

An intermediate transfer body 3 was obtained in a similar manner to the intermediate transfer body 1 except that the coating liquid 1 was changed to the coating liquid 3. A surface layer of the obtained intermediate transfer body 3 had a pure water contact angle of 84°.

(Intermediate Transfer Body 4)

An intermediate transfer body 4 was obtained in a similar manner to the intermediate transfer body 1 except that the coating liquid 1 was changed to the coating liquid 4. A surface layer of the obtained intermediate transfer body 4 had a pure water contact angle of 83°.

(Intermediate Transfer Body 5)

An intermediate transfer body 5 was obtained in a similar manner to the intermediate transfer body 1 except that the coating liquid 1 was changed to the coating liquid 5. A surface layer of the obtained intermediate transfer body 5 had a pure water contact angle of 78°.

(Intermediate Transfer Body 6)

An intermediate transfer body 6 was obtained in a similar manner to the intermediate transfer body 1 except that the coating liquid 1 was changed to the coating liquid 6. A surface layer of the obtained intermediate transfer body 6 had a pure water contact angle of 88°.

(Intermediate Transfer Body 7)

An intermediate transfer body 7 was obtained in a similar manner to the intermediate transfer body 1 except that the coating liquid 1 was changed to the coating liquid 7. A surface layer of the obtained intermediate transfer body 7 had a pure water contact angle of 86°.

(Intermediate Transfer Body 8)

An intermediate transfer body 8 was obtained in a similar manner to the intermediate transfer body 1 except that the coating liquid 1 was changed to the coating liquid 8. A surface layer of the obtained intermediate transfer body 8 had a pure water contact angle of 82°.

(Intermediate Transfer Body 9)

An intermediate transfer body 9 was obtained in a similar manner to the intermediate transfer body 1 except that the coating liquid 1 was clanged to the coating liquid 9. A surface layer of the obtained intermediate transfer body 9 had a pure water contact angle of 80°.

(Intermediate Transfer Body 10)

An intermediate transfer body 10 was obtained in a similar manner to the intermediate transfer body 1 except that the coating liquid 1 was changed to the coating liquid 10. A surface layer of the obtained intermediate transfer body 10 had a pure water contact angle of 80°.

(Intermediate transfer body 11)

An intermediate transfer body 11 was obtained in a similar manner to the intermediate transfer body 1 except that the coating liquid 1 was changed to the coating liquid 11. A surface layer of the obtained intermediate transfer body 11 had a pure water contact angle of 85°.

(Intermediate Transfer Body 12)

An intermediate transfer body 12 was obtained in a similar manner to the intermediate transfer body 1 except that the coating liquid 1 was changed to the coating liquid 12. A surface layer of the obtained intermediate transfer body 12 had a pure water contact angle of 80°.

(Intermediate Transfer Body 13)

An intermediate transfer body 13 was obtained in a similar manner to the intermediate transfer body 1 except that the coating liquid 1 was changed to the coating liquid 13. A surface layer of the obtained intermediate transfer body 13 had a pure water contact angle of 78°.

(Intermediate Transfer Body 14)

An intermediate transfer body 14 was obtained in a similar manner to the intermediate transfer body 1 except that the coating liquid 1 was changed to the coating liquid 14. A surface layer of the obtained intermediate transfer body 14 had a pure water contact angle of 80°.

(Intermediate Transfer Body 15)

An intermediate transfer body 15 was obtained in a similar manner to the intermediate transfer body 1 except that the coating liquid 1 was changed to the coating liquid 15. A surface layer of the obtained intermediate transfer body 15 had a pure water contact angle of 85°.

(Intermediate Transfer Body 16)

An intermediate transfer body 16 was obtained in a similar manner to the intermediate transfer body 1 except that the coating liquid 1 was changed to the coating liquid 16. A surface layer of the obtained intermediate transfer body 16 had a pure water contact angle of 84°.

(Intermediate Transfer Body 17)

An intermediate transfer body 17 was obtained in a similar manner to the intermediate transfer body 1 except that the coating liquid 1 was changed to the coating liquid 17. A surface layer of the obtained intermediate transfer body 17 had a pure water contact angle of 86°.

(Intermediate Transfer Body 18)

An intermediate transfer body 18 was obtained in a similar manner to the intermediate transfer body 1 except that the coating liquid 1 was changed to the coating liquid 18. A surface layer of the obtained intermediate transfer body 18 had a pure water contact angle of 77°.

(Intermediate Transfer Body 19)

An intermediate transfer body 19 was obtained in a similar manner to the intermediate transfer body 1 except that the coating liquid 1 was changed to the coating liquid 19. A surface layer of the obtained intermediate transfer body 19 had a pure water contact angle of 77°.

(Intermediate Transfer Body 20)

An intermediate transfer body 20 was obtained in a similar manner to the intermediate transfer body 1 except that the coating liquid 1 was changed to the coating liquid 20. A surface layer of the obtained intermediate transfer body 20 had a pure water contact angle of 84°.

(Intermediate Transfer Body 21)

An intermediate transfer body 21 was obtained in a similar manner to the intermediate transfer body 1 except that the coating liquid 1 was changed to the coating liquid 21. A surface layer of the obtained intermediate transfer body 21 had a pure water contact angle of 115°.

(Intermediate Transfer Body 22)

An intermediate transfer body 22 was obtained in a similar manner to the intermediate transfer body 1 except that the coating liquid 1 was changed to the coating liquid 22. A surface layer of the obtained intermediate transfer body 22 had a pure water contact angle of 71°.

(Intermediate Transfer Body 23)

An intermediate transfer body 23 was obtained in a similar manner to the intermediate transfer body 1 except that the coating liquid 1 was changed to the coating liquid 23. A surface layer of the obtained intermediate transfer body 23 had a pure water contact angle of 68°.

(Intermediate Transfer Body 24)

An intermediate transfer body 24 was obtained in a similar manner to the intermediate transfer body 1 except that the coating liquid 1 was changed to the coating liquid 24. A surface layer of the obtained intermediate transfer body 24 had a pure water contact angle of 65°.

(Intermediate Transfer Body 25)

An intermediate transfer body 25 was obtained in a similar manner to the intermediate transfer body 1 except that the coating liquid 1 was changed to the coating liquid 25. A surface layer of the obtained intermediate transfer body 25 had a pure water contact angle of 108°.

(Intermediate Transfer Body 26)

An intermediate transfer body 26 was obtained in a similar manner to the intermediate transfer body 1 except that the coating liquid 1 was changed to the coating liquid 26. A surface layer of the obtained intermediate transfer body 26 had a pure water contact angle of 65°.

Evaluation of image defect (streak) and evaluation of tape adhesion were performed for the intermediate transfer bodies 1 to 26.

[Method for Evaluating Image Defect (Streak)]

In the following measurement methods, unless otherwise specified, a device Bizhub C554 (manufactured by Konica Minolta, Inc.) was used, and A3 POD gloss coated paper (100 g/m$^2$) (manufactured by Oji Paper Co., Ltd) was used for image evaluation. As for a drum unit and a developing unit, new products were mounted immediately before a series of evaluations and were used as they were. As for a transfer roller and a cleaning blade in a configuration of intermediate transfer, genuine new products were used as they were.

(Evaluation of Image Defect (Streak))

Bizhub C554 and the intermediate transfer bodies 1 to 26 were stored under an environment of 20° C. and 50% RH, and humidity control was performed for 12 hours or more. Subsequently, each of the intermediate transfer bodies 1 to 26 was installed in Bizhub C554, and initialization and image stabilization were performed. Thereafter, switching was performed such that image stabilization was not performed. Bizhub C554 was left for one hour with no operation. Thereafter, an image with a printing ratio of cyan (C) of 25% (halftone image) was printed continuously on five sheets of A3.

Judgment of these images was performed with ⊙ to x by comparing these images with an "image in a case where the same image was collected with a conventional intermediate transfer body used in Bizhub C554 (hereinafter, referred to as"current product")".

(Judgment Criteria)

⊙: A streaky image defect cannot be confirmed.

○: A streaky image defect is slightly visible.

Δ: A streaky image defect is visible but is at a level having no problem.

x: A streaky image defects is clearly visible.

Table 4 illustrates results of evaluation of an image defect (streak) and evaluation of the adhesive strength of a tape for the intermediate transfer bodies 1 to 26. Here, Table 4 also illustrates the pure water contact angles of the surface layers of the intermediate transfer bodies 1 to 26 in order to evaluate a relationship among the contact angle, occurrence of image defect (streak), and the adhesive strength of a tape.

TABLE 4

| | Evaluation | | |
|---|---|---|---|
| | Pure water contact angle | Image defect (streak) | Adhesive strength of tape |
| Intermediate transfer body 1 | 79 | ○ | ⊙ |
| Intermediate transfer body 2 | 82 | ⊙ | ⊙ |
| Intermediate transfer body 3 | 84 | ⊙ | ⊙ |
| Intermediate transfer body 4 | 83 | ⊙ | ⊙ |
| Intermediate transfer body 5 | 78 | ⊙ | ⊙ |
| Intermediate transfer body 6 | 88 | ⊙ | ○ |
| Intermediate transfer body 7 | 86 | ⊙ | ○ |
| Intermediate transfer body 8 | 82 | ⊙ | ⊙ |
| Intermediate transfer body 9 | 80 | ○ | ⊙ |
| Intermediate transfer body 10 | 80 | ○ | ⊙ |
| Intermediate transfer body 11 | 85 | ○ | ⊙ |
| Intermediate transfer body 12 | 80 | ○ | ⊙ |
| Intermediate transfer body 13 | 78 | ○ | ⊙ |
| Intermediate transfer body 14 | 80 | ○ | ⊙ |
| Intermediate transfer body 15 | 85 | ⊙ | ⊙ |
| Intermediate transfer body 16 | 84 | ⊙ | ⊙ |
| Intermediate transfer body 17 | 86 | ⊙ | ○ |
| Intermediate transfer body 18 | 77 | ⊙ | ⊙ |
| Intermediate transfer body 19 | 77 | ⊙ | ⊙ |
| Intermediate transfer body 20 | 84 | ⊙ | ⊙ |
| Intermediate transfer body 21 | 115 | X | X |
| Intermediate transfer body 22 | 71 | X | Δ |
| Intermediate transfer body 23 | 68 | X | ⊙ |
| Intermediate transfer body 24 | 65 | ○ | ○ |
| Intermediate transfer body 25 | 108 | ○ | X |
| Intermediate transfer body 26 | 65 | X | X |

The adhesive strength of a tape was evaluated using the intermediate transfer bodies 1 to 26.

[Method for Evaluating Adhesive Strength of Tape]

Figure 5A:
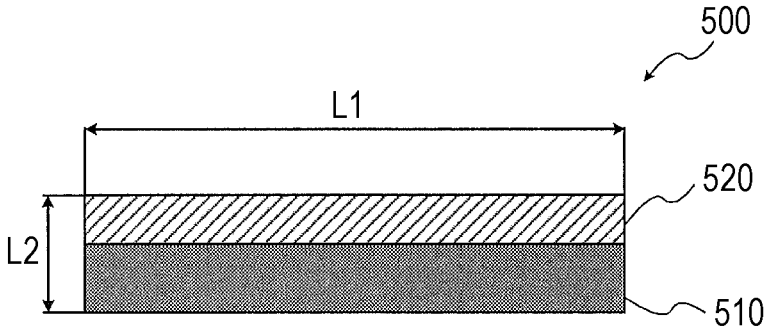
FIG. 5A is a cross-sectional view illustrating a state in which a tape is stuck onto an intermediate transfer body used in evaluation of tape adhesion.
Figure 5B:
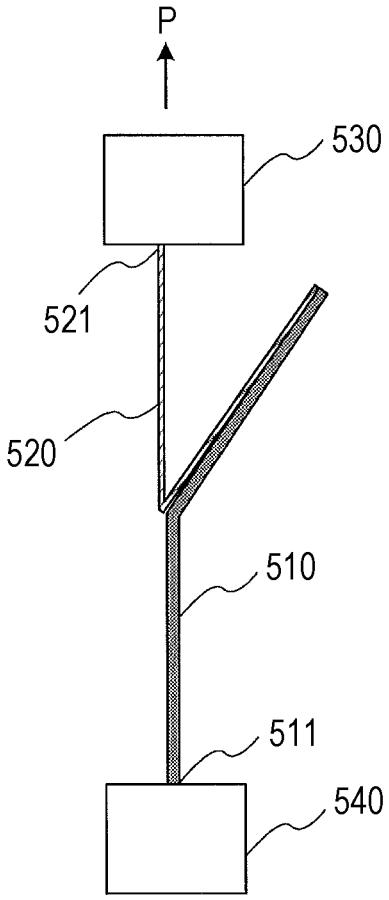
FIG. 5B is a view illustrating a method for evaluating tape adhesion of the intermediate transfer body according to the embodiment.

As illustrated in FIG. 5A, a polyethylene naphthalate (PEN) tape (product name 636F #50, manufactured by Temoka Seisakusho Co., Ltd.) was stuck to a part of an outer peripheral surface of an intermediate transfer body 510 (each of the intermediate transfer bodies 1 to 26). Thereafter, the resulting product was left as it was for 24 hours or more. Subsequently, the intermediate transfer body was cut out as an evaluation sample 500 so as to have a width L1 (70 mm) and a height L2 (10 mm) from the part to which the tape had been stuck. Thereafter, as illustrated in FIG. 5B, the intermediate transfer body 510 and a tape 520 constituting the sample 500 were partially peeled off from each other. An end 521 of the tape 520 was held by a holder 530, and an end 511 of the intermediate transfer body 510 was held by a holder 540. Thereafter, the holder 530 was pulled in an arrow direction P (vertical direction from the holder 540) at a pulling speed of 100 mm/min, and the adhesive strength of the tape was measured. Judgment of the adhesive strength of the tape was performed with ⊙ to x for the intermediate transfer body 510 (each of the intermediate transfer bodies 1 to 26). Here, in the present evaluation, a maximum value when a displacement was within a range of 10 to 20 mm was taken as a measurement value of the adhesive strength.

(Judgment Criteria)

⊙: 3.0 N or more (available)

○: 2.0 N or more and less than 3.0 (available)

Δ: 0.8 N or more and less than 2.0 (available)

x: less than 0.8 N (not available)

As illustrated in Table 4, in evaluation of an image defect (streak) and evaluation of the adhesive strength of a tape for the intermediate transfer bodies 1 to 20 having surface layers including the coating liquids 1 to 20 containing fluorine-based surfactants having reactive groups in Table 2, good results were obtained. In particular, in both evaluation of an application streak and evaluation of the adhesive strength of a tape for the intermediate transfer bodies 2 to 5, 8, and 15, excellent results were obtained.

From the above results, it has been found that addition of a fluorine-based surfactant having a reactive group to a surface layer forming coating liquid improves a dispersed state of metal oxide fine particles in the coating liquid, and can suppress aggregation of the metal oxide fine particles. In addition, it has been found that use of a monofunctional (meth)acrylic monomer having a long chain alkyl group together with a polyfunctional monomer having a (meth) acryloyl group and a fluorine-based surfactant having a (meth)acryloyl group can improve not only dispersion but also lubricity. This makes it possible to easily obtain an intermediate transfer body having a smooth surface.

In addition by adjusting the addition amount of a fluorine-based surfactant having a reactive group such that the pure water contact angle of the surface layer was 75° or more and 90° or less, adhesion between the surface layer and a tape could be improved. It is considered that this is because compatibility of the surfactant with the polyfunctional monomer and monofunctional monomer suppressed extreme orientation of a fluorine portion of the fluorine-based surfactant to a surface, and as a result, bleeding out of the flourine-based surfactant to the surface could be suppressed.

The present invention is useful as an intermediate transfer body of an image forming device aiming at high image quality in image formation.

According to an embodiment of the present invention, an intermediate transfer body having a smooth surface layer can be provided. In addition, a method for manufacturing the intermediate transfer body and an image forming device including the intermediate transfer body can be provided.

Although embodiments of the present invention have been described and illustrated in detail, the disclosed embodiments are made for purposes of illustration and example only and not limitation. The scope of the present invention should be interpreted by terms of the appended claims.

What is claimed is:

1. An intermediate transfer body used in an electrophotographic image forming device, comprising at least a substrate layer and a surface layer, wherein the surface layer is formed by a cured product obtained by curing a coating liquid containing a curable compound, an inorganic filler, and a fluorine-based surfactant having a reactive group, the surface layer has a pure water contact angle of 75° or more and 90° or less, the curable compound contains a curable compound having a (meth)acryloyl group, and the fluorine-based surfactant having a reactive group has a (meth)acryloyl group.

2. The intermediate transfer body according to claim 1, wherein the surface layer has a pure water contact angle of 75° or more and 85° or less.

3. The intermediate transfer body according to claim 1, wherein the coating liquid contains the fluorine-based surfactant having a reactive group in an amount of 0.01 parts by volume or more and 0.20 parts by volume or less with respect to the sum of the curable compound and the fluorine-based surfactant.

4. The intermediate transfer body according to claim 1, wherein the coating liquid contains the fluorine-based surfactant having a reactive group in an amount of 0.01 parts by volume or more and 0.10 parts by volume or less with respect to the sum of the curable compound and the fluorine-based surfactant.

5. The intermediate transfer body according to claim 1, wherein the inorganic filler is formed by metal oxide fine particles.

6. The intermediate transfer body according to claim 5, wherein the metal oxide fine particles have surfaces surface-modified with a reactive group having a structure represented by the following general formula (1):

[Chemical formula 1]

$$CH_2{=}C(R_1)COO(CH_2)_nSi{-} \quad (1)$$

where $R_1$ represents a hydrogen atom or a methyl group, and n represents an integer of 3 to 6.

7. The intermediate transfer body according to claim 1, wherein the curable compound contains a polyfunctional monomer having three or more (meth)acryloyl groups, and the polyfunctional monomer has a (meth)acryloyl group equivalent of 150 g/eq or more and 250 g/eq or less.

8. The intermediate transfer body according to claim 1, wherein the curable compound contains a monofunctional monomer represented by the following general formula (2):

[Chemical formula 2]

$$CH_2{=}O(R_2)COO(CH_2)_mCH_3 \quad (2)$$

where $R_2$ represents a hydrogen atom or a methyl group, and m represents an integer of 14 to 20.

9. The intermediate transfer body according to claim 8, wherein the coating liquid contains the monofunctional monomer represented by the general formula (2) in an amount of 5 parts by volume or more and 20 parts by volume or less with respect to 100 parts by volume of the sum of the curable compound and the inorganic filler.

10. The intermediate transfer body according to claim 1, wherein the coating liquid contains the inorganic filler in an amount of 10 parts by volume or more and 30 parts by volume or less with respect to 100 parts by volume of the sum of the curable compound and the inorganic filler.

11. A method for manufacturing the intermediate transfer body according to claim 1, comprising applying a surface layer forming coating liquid to an outer peripheral surface of a substrate layer while rotating the substrate layer using a nozzle to form the surface layer, wherein the surface layer forming coating liquid contains the curable compound, the inorganic filler, and the fluorine-based surfactant having a reactive group.

12. An image forming device comprising the intermediate transfer body according to claim 1.

13. An intermediate transfer body used in an electrophotographic image forming device, comprising at least a substrate layer and a surface layer, wherein the surface layer is formed by a cured product obtained by curing a coating liquid containing a curable compound, an inorganic filler, and a fluorine-based surfactant having a reactive group, the surface layer has a pure water contact angle of 75° or more and 90° or less, the inorganic filler is formed by metal oxide fine particles, and the metal oxide fine particles have surfaces surface-modified with a reactive organic group.

* * * * *